US008833466B2

(12) United States Patent
Zhou

(10) Patent No.: US 8,833,466 B2
(45) Date of Patent: Sep. 16, 2014

(54) SELF-CONTROLLED INFLOW CONTROL DEVICE

(75) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 415 days.

(21) Appl. No.: 13/276,382

(22) Filed: Oct. 19, 2011

(65) Prior Publication Data

US 2013/0068467 A1 Mar. 21, 2013

Related U.S. Application Data

(60) Provisional application No. 61/535,802, filed on Sep. 16, 2011.

(51) Int. Cl.

| | |
|---|---|
| ***E21B 34/06*** | (2006.01) |
| ***E21B 43/12*** | (2006.01) |
| ***E21B 34/08*** | (2006.01) |
| ***E21B 43/14*** | (2006.01) |

(52) U.S. Cl.

CPC ..... *E21B 34/08* (2013.01); *E21B 43/12* (2013.01); *E21B 43/14* (2013.01)

USPC ..... 166/369; 166/319

(58) Field of Classification Search

USPC ..... 166/369, 319, 242.5

See application file for complete search history.

(56) References Cited

U.S. PATENT DOCUMENTS

| | | | |
|---|---|---|---|
| 5,355,953 | A | 10/1994 | Shy et al. |
| 5,494,109 | A | 2/1996 | Schmitt |
| 7,413,022 | B2 | 8/2008 | Broome et al. |
| 7,469,743 | B2 | 12/2008 | Richards |
| 7,537,056 | B2 | 5/2009 | MacDougall |
| 7,559,375 | B2 | 7/2009 | Dybevik et al. |

(Continued)

FOREIGN PATENT DOCUMENTS

| | | |
|---|---|---|
| GB | 2476148 | 6/2011 |

OTHER PUBLICATIONS

PCT International Search Report and the Written Opinion of the International Searching Authority dated Nov. 5, 2013; International Application No. PCT/US2012/055310; International File Date: Sep. 14, 2012.

(Continued)

*Primary Examiner* — William P Neuder

(74) *Attorney, Agent, or Firm* — Bracewell & Giuliani LLP; Constance Gall Rhebergen; Keith R. Derrington

(57) ABSTRACT

An inflow control device controls the rate of fluid flow from a subsurface fluid reservoir into a production tubing string. The inflow control device includes a particulate screen to remove particulate matter from the reservoir fluid, and at least two flow restrictors. The flow restrictors are positioned on circumferentially opposite sides of the inflow control device and are connected by an isolated fluid passage. The flow restrictors limit the flowrate of reservoir fluid when the reservoir fluid has a high water or gas-to-oil ratio. The inflow control device also includes at least one pressure drop device that generates a pressure drop for the reservoir fluid in response to fluid pressure in the reservoir. The inflow control device also includes a choking apparatus that allows the flow of reservoir fluid to be shut off and the particulate screen cleaned while the inflow control device is in place in hole.

18 Claims, 15 Drawing Sheets

(56) References Cited

U.S. PATENT DOCUMENTS

| | | | | |
|---|---|---|---|---|
| 7,578,343 | B2 | 8/2009 | Augustine | |
| 7,597,150 | B2 | 10/2009 | Clem | |
| 7,775,284 | B2 | 8/2010 | Richards et al. | |
| 7,789,145 | B2 | 9/2010 | Patel | |
| 7,802,621 | B2 | 9/2010 | Richards et al. | |
| 7,823,645 | B2 | 11/2010 | Henriksen et al. | |
| 7,828,067 | B2 | 11/2010 | Scott et al. | |
| 7,857,061 | B2 | 12/2010 | Richards | |
| 2007/0246407 | A1* | 10/2007 | Richards et al. | 210/97 |
| 2008/0041580 | A1* | 2/2008 | Freyer et al. | 166/193 |
| 2008/0041582 | A1 | 2/2008 | Saetre et al. | |
| 2008/0041588 | A1* | 2/2008 | Richards et al. | 166/265 |
| 2008/0283238 | A1 | 11/2008 | Richards et al. | |
| 2009/0095487 | A1 | 4/2009 | Xu et al. | |
| 2009/0101354 | A1 | 4/2009 | Holmes et al. | |
| 2009/0120647 | A1 | 5/2009 | Turick et al. | |
| 2009/0151925 | A1* | 6/2009 | Richards et al. | 166/53 |
| 2009/0205834 | A1 | 8/2009 | Garcia et al. | |
| 2009/0301730 | A1 | 12/2009 | Gweily | |
| 2011/0067878 | A1 | 3/2011 | Aadnoy | |
| 2011/0067886 | A1 | 3/2011 | Moen | |
| 2011/0073308 | A1 | 3/2011 | Assal et al. | |
| 2011/0147006 | A1 | 6/2011 | O'Malley et al. | |
| 2011/0147007 | A1 | 6/2011 | O'Malley et al. | |

OTHER PUBLICATIONS

PCT Partial International Search Report dated Aug. 21, 2013; International Application No. PCT/US2012/055310; International Filing date: Sep. 14, 2012.

* cited by examiner

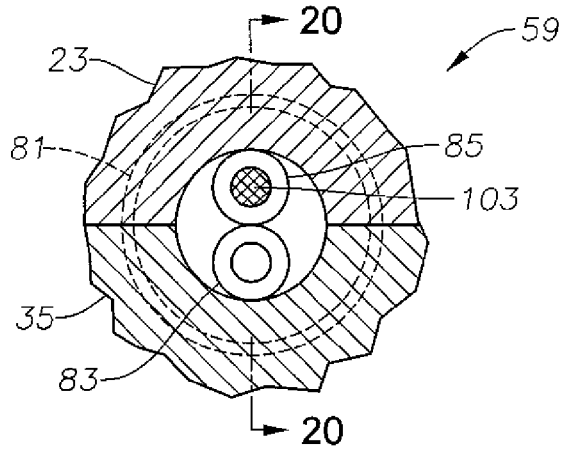
Fig. 19
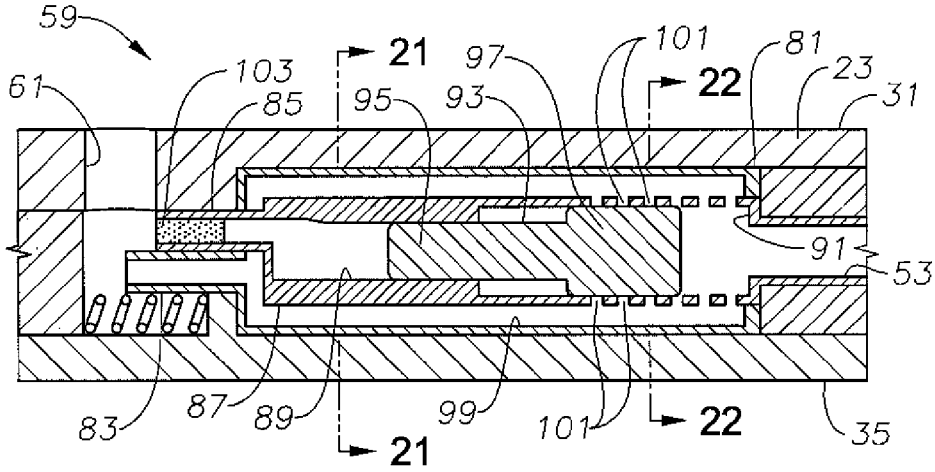
Fig. 20
Fig. 21
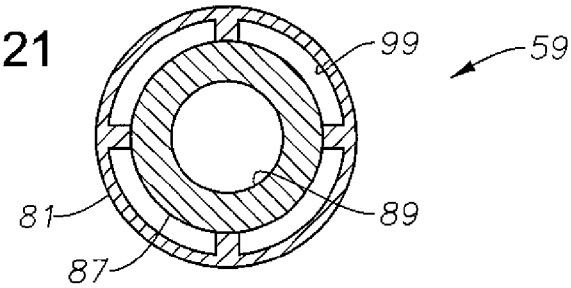
Fig. 22
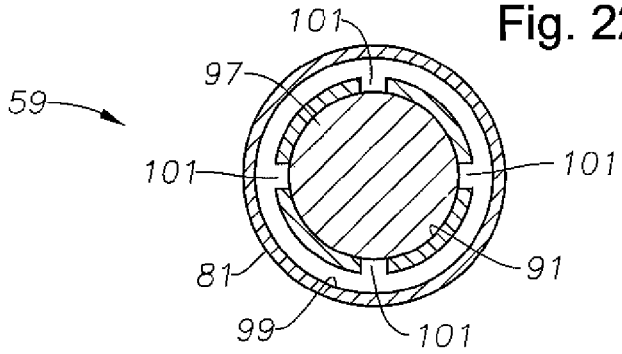

SELF-CONTROLLED INFLOW CONTROL DEVICE

This application claims priority to and the benefit of U.S. Provisional Application No. 61/535,802, filed on Sep. 16, 2011, entitled "Self-Controlled Inflow Control Device," which application is hereby incorporated herein by reference.

BACKGROUND OF THE INVENTION

1. Field of the Invention

The present invention relates in general to well production devices and, in particular, to a self-controlled inflow control device.

2. Brief Description of Related Art

Some well completions use lateral lines to penetrate horizontally across a reservoir. These horizontal well sections extend through a reservoir at the same general elevation to produce fluid from across the reservoir rather than a localized area around a vertical well. The lateral lines extend from a heel at the junction of the lateral line with the vertical line to a toe at the end of the lateral line. Fluid along the horizontal wellbore profile will flow into the production tubing all along the lateral. However, the fluid flowing into the heel will block flow from the toe, preventing production of fluid from the entire reservoir profile to the surface. Instead, the majority of the produced fluid will be drawn from the formation areas around the heel. This may lead to coning. Coning refers to the cone shape reservoir fluid movement front, i.e. a boundary between desired reservoir fluid and undesired reservoir fluid, when too much reservoir production occurs from a single zone of the well. As reservoir fluid is produced from the formation, surrounding fluids, such as water, will flow into the produced areas. If the produced fluid flowrate is too high, the water will fill the area before desired fluid can replace the produced fluid. In a lateral well, production only at the heel will draw water into the formation at the heel. As the heel produces water, it will block formation fluid from the toe. In these situations, inflow control devices (ICDs) are used to restrict the flow of reservoir fluid from the heel and other high pressure areas of the formation to create a more even production profile that produces reservoir fluid from the formation and prevent coning.

Inflow control devices restrict flow by forcing fluid through restricted passageways to create a pressure differential. This pressure differential must be overcome by the pressure in the reservoir surrounding the inflow control device. Where reservoir pressure is high, the pressure will overcome the inflow control device pressure differential and be produced to the surface. As production causes a pressure drop in the reservoir around the inflow control device, the reservoir pressure will no longer overcome the inflow control device pressure differential, limiting production from that area until reservoir pressure increases. Reservoir formations are tested before the inflow control devices are run-in-hole, and the inflow control devices are adjusted prior to run-in to accommodate the pressure for the specific zone of the reservoir in which the inflow control device is placed. These inflow control devices have difficulties maintaining the desired production profile for longer production periods, eventually completely stopping production as the reservoir pressure drops. To overcome this, some inflow control devices include mechanisms that allow the inflow control device to vary the pressure differential to accommodate reservoir pressure changes. These inflow control devices use hydraulically controlled functions powered by hydraulic umbilicals that supply fluid pressure from the surface. These inflow control devices are significantly more expensive to use due to the specialty equipment needed to run the hydraulic umbilical and monitor it from the surface.

In addition, many inflow control devices are unable to actively restrict the fluid flowrate of reservoir fluid through the inflow control device and adjust for reservoir fluid flow that has a high volume of gas or a high volume of water in the flow. Thus, if a portion of the well begins to produce a gas or water, the inflow control device cannot further restrict flow to limit the percentage of water or gas in the fluid produced at the surface. Some inflow control devices include equipment that may be operated from the surface to accommodate for these situations, but similar to the hydraulic pressure adjustment equipment, the inflow control devices need expensive hydraulic or electric umbilicals to perform the water and gas restriction function. These inflow control devices also require an extensive and expensive testing process to determine which portion of the well is producing the water and gas. Still further, some inflow control devices include means to restrict water and gas flow using devices that respond to varying fluid density in the reservoir. These devices must then mate with corresponding nozzles to restrict fluid flow. However, many of these devices are unable to successfully operate outside of specific known density conditions. Thus, in the event there is a significant variance in the expected reservoir fluid density, the devices are unable to properly limit flow of the water or gas. Typically, these devices may only accommodate restriction of either water or gas, but not both.

Another problem faced by use of inflow control devices, particularly in well formations using an openhole production process is clogging of filter media. As the inflow control device is used, particulate matter builds up on the filter and blocks flow of fluid from the reservoir into the inflow control device and production tubing. Still another problem faced by inflow control devices is the inability of the inflow control device to be choked back or turned off by an operator at the surface to prevent flow of reservoir fluid through the inflow control device under predetermined conditions. Therefore, an inflow control device that overcomes the problems of the prior art described above would be desirable.

SUMMARY OF THE INVENTION

These and other problems are generally solved or circumvented, and technical advantages are generally achieved, by preferred embodiments of the present invention that provide a self-controlled inflow control device, and a method for using the same.

In accordance with an embodiment of the present invention, an inflow control device for controlling fluid flow from a subsurface fluid reservoir into a production tubing string is disclosed. The inflow control device includes a tubular member defining a central bore having an axis, wherein upstream and downstream ends of the tubular member may couple to the production tubing string. A plurality of passages are formed in a wall of the tubular member. The inflow control device includes an upstream inlet to the plurality of passages leading to an exterior of the tubular member to accept fluid. Each passage has at least two flow restrictors with floatation elements of selected and different densities to restrict flow through the flow restrictors in response to a density of the fluid. The inflow control device includes at least one pressure drop device positioned within each passage in fluid communication with an outflow of the flow restrictors, the pressure drop device having a pressure piston for creating a pressure differential in the flowing fluid based on the reservoir fluid pressure. An outflow of the pressure drop device flows into an inflow fluid port in communication with the central bore.

In accordance with another embodiment of the present invention, an inflow control device for controlling fluid flow from a subsurface fluid reservoir into a production tubing string for production to a surface is disclosed. The inflow control device includes a tubular member defining a central bore having an axis with a plurality of passages formed in a wall of the tubular member. Each passage partially circumscribes the tubular member so that a terminus of each passage is 180 degrees from a head of the passage. The inflow control device also includes at least two flow restrictors having floatation members of selected and different densities positioned within each flow restrictor to restrict flow of reservoir fluid having a high water-to-oil ratio and a high gas-to-oil ratio. A passage of the plurality of passages is vertically oriented so that at least one of the corresponding flow restrictors is at a highest elevation of the inflow control device and at least one of the corresponding flow restrictors is at a lowest elevation of the inflow control device. At least one pressure drop device is positioned within each passage in fluid communication with an outflow of the flow restrictors. The pressure drop device creates a pressure differential in the flowing fluid with a pressure piston in response to the reservoir fluid pressure. An outflow of the pressure drop device flows into an inflow fluid port in communication with the central bore. A pressure actuated choke apparatus is positioned downstream of the pressure drop device to restrict flow of fluid from the plurality of passages into the central bore in response to fluid pressure applied to the production tubing string at the surface. A filter media is positioned within an annular opening defined by the tubular member near an upstream end of the inflow control device, the filter media allowing fluid communication between the subsurface fluid reservoir and the plurality of passages. The inflow control device also includes a pressure actuated member positioned on an upstream end of the inflow control device and actuable in response to a pressure within the central bore to allow fluid communication from the central bore to the filter media to clean the filter media.

In accordance with yet another embodiment of the present invention, a method for producing fluid from a subsurface reservoir with an inflow control device is disclosed. The method couples at least one inflow control device to a production tubing string, and runs the production tubing string into a wellbore. The method then applies fluid pressure to the tubing string to prevent flow of reservoir fluid through the inflow control device during run-in of the production tubing string. The method then removes fluid pressure from the production tubing string to allow reservoir fluid to flow into the production tubing string through the inflow control device while restricting flow of reservoir fluid having a high water-to-oil ratio and a high gas-to-oil ratio and controlling the flow rate of the reservoir fluid with the inflow control device. In the event a substantial interruption of reservoir fluid flow occurs, the method applies a fluid pressure to the production tubing string greater than the fluid pressure applied during run-in to cause fluid flow through the inflow control device and into the reservoir. The method then removes the fluid pressure to continue production of reservoir fluid.

An advantage of the disclosed embodiments is that they provides an inflow control device that may be used to create a pressure drop to reduce reservoir fluid flow and maintain a balanced production profile across multiple production zones, particularly those at the same elevation. The disclosed inflow control devices accommodate varying reservoir pressure by varying the pressure differential in response to the reservoir pressure. Still further, the disclosed embodiments will restrict the flow of production fluid having high volumes of water or gas based on the ratio of those substances within the reservoir fluid. In addition, the disclosed embodiments will remove solid particulate matter from the reservoir fluid flow. The disclosed embodiments remove particulates and include a process to allow for washing of the inflow control device while in place in hole. This allows for a longer life of the inflow control device with fewer problems related to plugging or blockage as compared to other inflow control devices.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

FIG. 19 is an end view of a pressure drop device of FIG. 2A in accordance with an embodiment of the present invention.

FIG. 20 is a sectional view of the pressure drop device of FIG. 2A taken along line 20-20 of FIG. 19.

FIGS. 21-22 are sectional views of the pressure drop device of FIG. 2A taken along line 21-21 and 22-22 of FIG. 20, respectively.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention may be practiced without such specific details. Additionally, for the most part, details concerning well drilling, reservoir testing, well completion, and the like have been omitted inasmuch as such details are not considered necessary to obtain a complete understanding of the present invention, and are considered to be within the skills of persons skilled in the relevant art.

Figure 1:
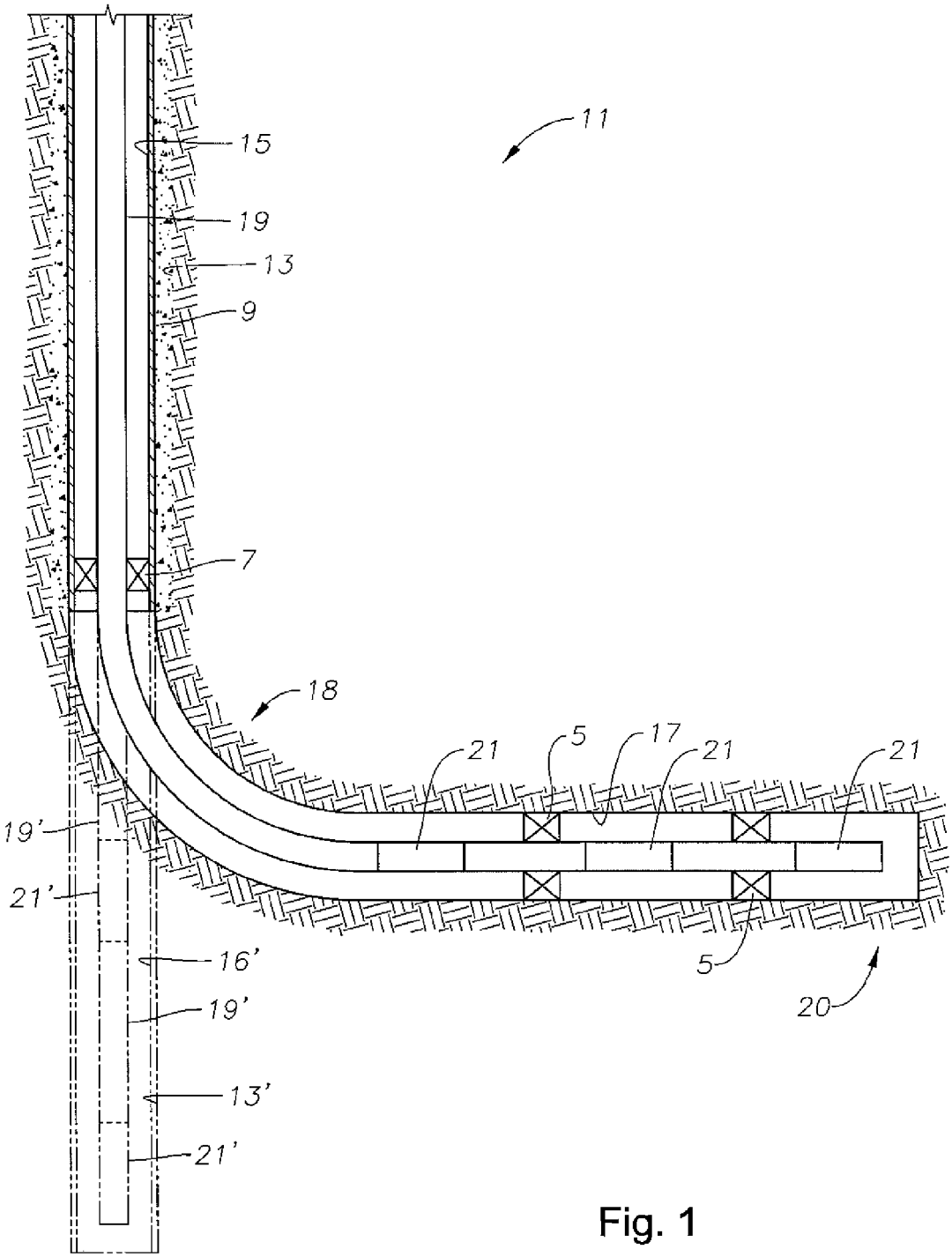
FIG. 1 is a schematic representation of a portion of a production well in accordance with an embodiment of the present invention.

Referring to FIG. 1, a well system 11 includes a wellbore 13 that is at least partially completed with a casing string 15. In the illustrated embodiment wellbore 13 includes a lateral 17 having a heel 18 and a toe 20 extending horizontally from wellbore 13. Wellbore 13 may be installed with a casing string 15 cemented in place with a cement layer 9. Cement layer 9 may protect casing 15 and act as an isolation barrier. Lateral 17 may be uncased as shown. Alternatively lateral 17 may be completed with a casing string similar to casing string 15. A production tubing string 19 is suspended within casing string 15 and lateral 17. A production packer 7 placed within an annulus between production tubing string 19 and casing string 15 may isolate production tubing string 19 below an end of casing string 15. Production string 19 may include an inflow control device 21 (three of which are shown) to aid in the controlled flow of fluid from a formation surrounding lateral 17 into production tubing 19 as described in more detail below. In the illustrated embodiment, each inflow control device 21 is isolated in a separate zone by an open hole packer 5, two of which are shown. Production tubing 19 may be closed at toe 20, or alternatively include a packer on an upstream end of production tubing 19 to prevent direct flow of reservoir fluids into a bore of production tubing 19. In alternative embodiments, shown in dashed lines in FIG. 1, wellbore 13 may not include lateral 17 and will extend vertically to a terminus of wellbore 13'. Casing string 15' may extend to the terminus of wellbore 13' and production tubing 19', having inflow control devices 21', and will not include horizontal portions, but will complete the well in a vertical manner as shown.

Figure 2A:
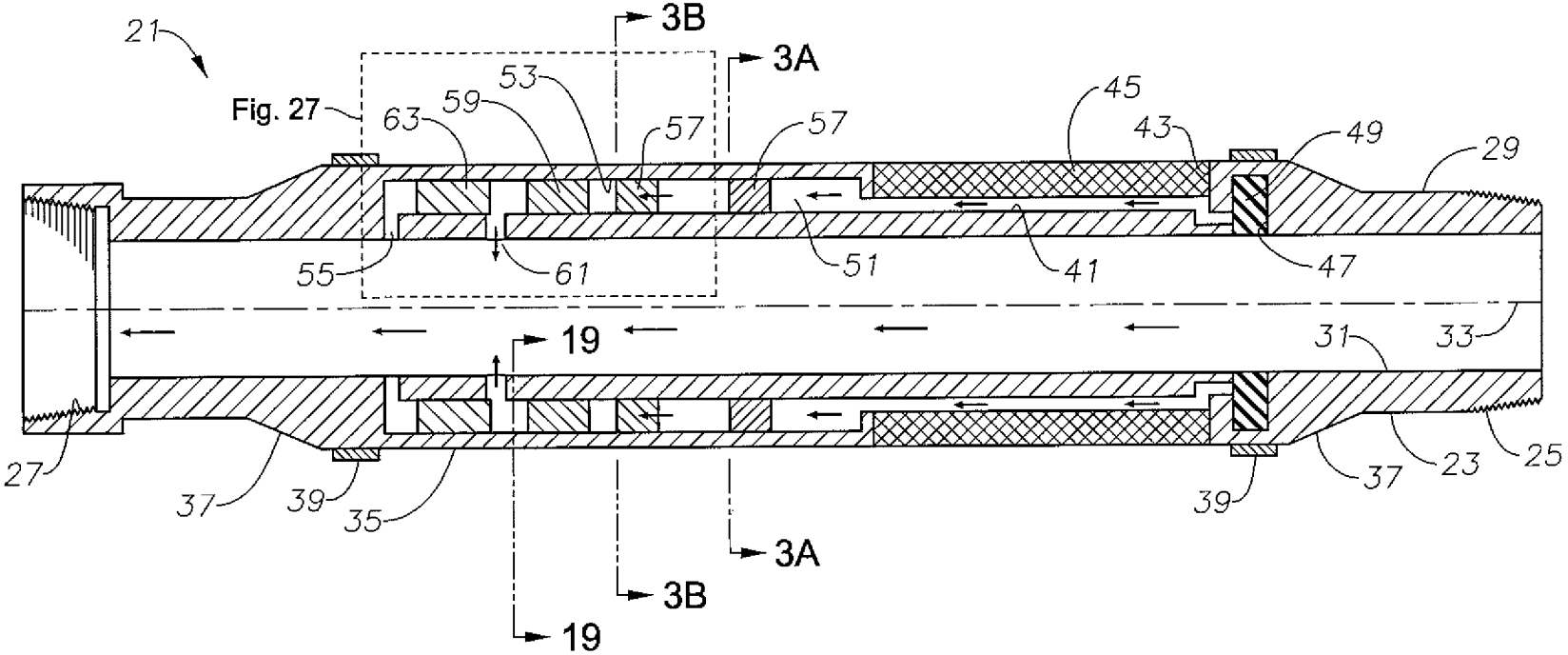
FIG. 2A is a schematic side sectional view of an inflow control device during a production process in accordance with an embodiment of the present invention.

Referring to FIG. 2A, inflow control device 21 is shown in a side sectional view. Inflow control device 21 may be a tubular member 23 having threaded pin connection 25 at a downhole end of tubular member 23, i.e. closer to toe 20 of lateral 17, and a threaded box connection 27 at an uphole end of tubular member 23, i.e. closer to heel 18 of lateral 17. Tubular member 23 has an outer diameter 29 and defines a central bore 31 having an axis 33. Production tubing 19 may couple to tubular member 23 at threaded connections 25, 27 so that fluid, such as reservoir fluid, drilling fluid, cleaning fluid, or the like may be circulated through central bore 31.

A tubular housing 35 having a conical ends 37 encircles tubular member 23. Conical ends 37 will join to tubular member 23 at outer diameter 29 of tubular member 23 so that fluid may not flow into tubular housing 35 along outer diameter 29 of tubular member 23. Although described herein as separate components, tubular housing 35 and tubular member 23 may be integral components formed as a single body. Tubular housing 35 includes annular standoffs 39 positioned on an outer diameter of tubular housing 35 at opposite ends of tubular housing 35. Standoffs 39 will contact an inner diameter of casing string 15 (FIG. 1) or wellbore 17 (FIG. 1) so that an annulus may be maintained around inflow control device 21. Tubular housing 35 will have an inner diameter greater than outer diameter 29 to form an annulus 41 between tubular member 23 and tubular housing 35. Tubular housing 35 may define an annular recess or opening 43 in fluid communication with annulus 41. A filter media 45 will be positioned within annular opening 43 so that fluid in casing string 15 or lateral 17 may flow into annulus 41 through filter media 45. Filter media 45 may be any suitable media type such as a wire screen or the like, provided the selected media prevents flow of undesired particulate matter from lateral 17 into annulus 41.

Annulus 41 may communicate with central bore 31 through fluid passages formed in tubular housing 35. In the illustrated embodiment, a fluid wash port 47 is positioned proximate to threaded pin connection 25 and extends from central bore 31 into annulus 41. Fluid wash port 47 may be positioned between opening 43 and conical end 37 of tubular housing 35 so that, as described in more detail below, fluid may flow from central bore 31 into annulus 41 and through filter media 45 under predetermined conditions. Fluid wash port 47 is an annular flow passage, and a compressible disc 49 may be positioned within fluid wash port 47. Compressible disc 49 is an annular member formed of a suitable material so that compressible disc 49 may compress when subjected to a predetermined fluid pressure to allow fluid communication between central bore 31 and annulus 41 as described in more detail below.

In the illustrated embodiment, annulus 41 may define a fluid collecting chamber 51. Fluid collecting chamber 51 is an annular chamber proximate to opening 43 and filter media 45 opposite fluid wash port 47. Fluid may flow from lateral 17 through filter media 45 and into fluid collecting chamber 51. A plurality of isolated passages 53 may extend from fluid collecting chamber 51 to a piston fluid port 55 opposite fluid wash port 47 and proximate to box end connection 27. In the illustrated embodiment, eight passages 53 are used; however, a person skilled in the art will understand that more or fewer passages 53 may be used depending on the nature of the well into which inflow control device 21 is placed. In an alternate embodiment, twelve passages 53 are used. Each passage 53 will be spaced equidistantly around the circumference of tubular member 23 from the adjacent passages 53. Each passage 53 will include two flow restrictors 57 positioned within passage 53 proximate to fluid collecting chamber 51 so that fluid in fluid collecting chamber 51 may flow through flow restrictors 57. A pressure drop device 59 will then be positioned within passage 53 proximate to flow restrictors 57 so that fluid flowing through flow restrictors 57 may flow into pressure drop device 59. Fluid flowing through pressure drop device 59 may then flow out of a tubing inflow port 61 into central bore 31. A piston 63 will be positioned within passage 53 in the fluid flow path of fluid flowing from pressure drop device 59. Piston 63 may move to variably allow or prevent fluid flow from pressure drop device 59 to enter central bore 31. Piston fluid port 55 allows fluid communication between piston 63 opposite pressure drop device 59 and central bore 31 to actuate movement of piston 63 to prevent fluid flow through tubing inflow port 61.

Figure 2B:
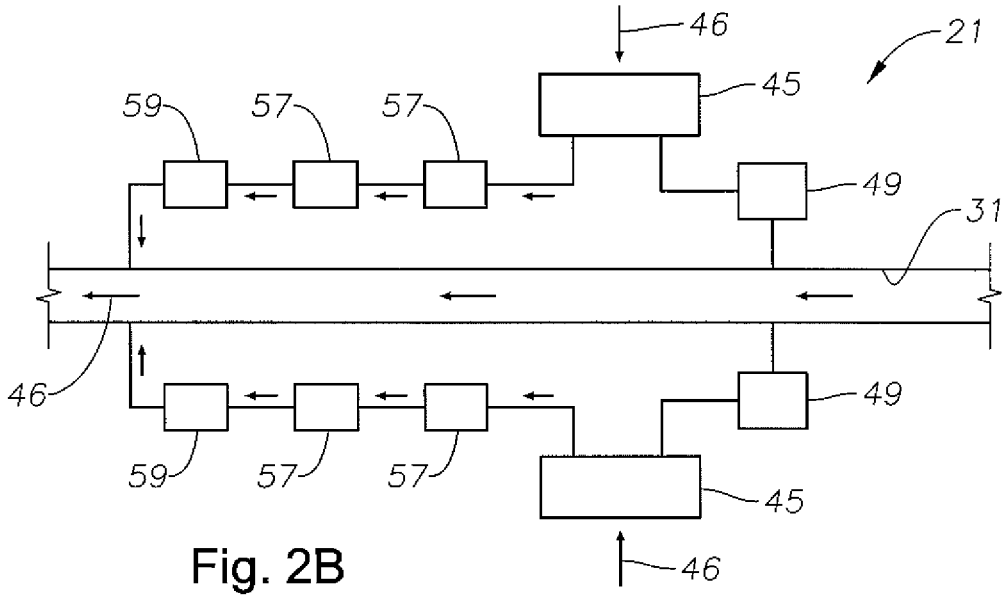
FIG. 2B is a schematic representation of fluid flow through the inflow control device of FIG. 2A during the production process.
Figure 2C:
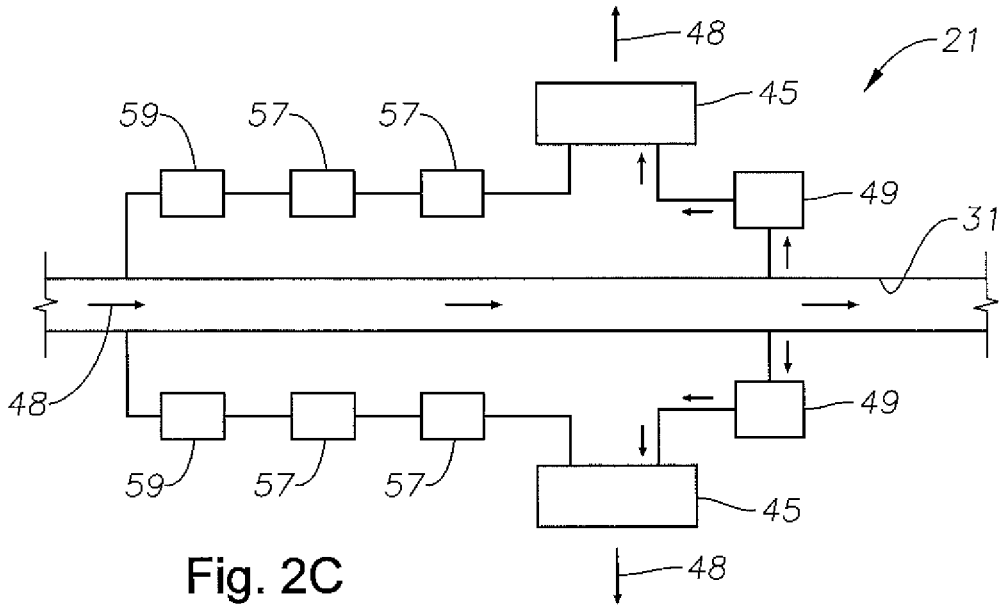
FIG. 2C is a schematic representation of fluid flow through the inflow control device of FIG. 2A during a remedial or backwash process.

As shown in FIG. 2B, during a production phase, fluid from a reservoir surrounding lateral 17 (FIG. 1) may flow through inflow control device 21 as indicated by fluid 46. Fluid will pass through filter media 45 into inflow control device 21. There fluid will be directed through upstream and downstream flow restrictors 57 as described in more detail below. After flowing through flow restrictors 57, fluid will be directed through pressure drop device 59. From pressure drop device 59, fluid may flow into central bore 31 as described in more detail below. Referring to FIG. 2C, during a remedial or backwash phase, fluid may be circulated down production tubing string 19 (FIG. 1) into central bore 31 of inflow control device 21 as indicated by fluid 48. Piston 63 will prevent flow of fluid 48 from central bore 31 into pressure drop device 59 and downstream and upstream flow restrictors 57 as described in more detail below. Fluid 48 will have a sufficient fluid pressure to actuate pressure disc 49. Fluid 48 may then flow through pressure disc 49 and through filter media 45 into the formation surrounding inflow control device 21 as described in more detail below.

Figure 3D:
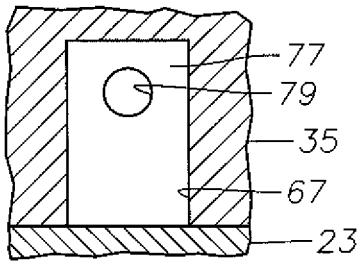
FIGS. 3D-3E are front views of a downstream porting wall and an upstream porting wall, respectively, of FIG. 3C.
Figure 3E:
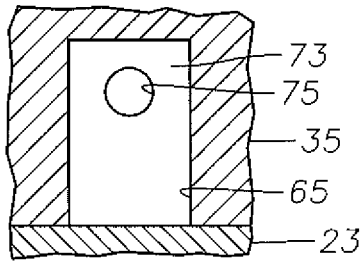
Figure 3A:
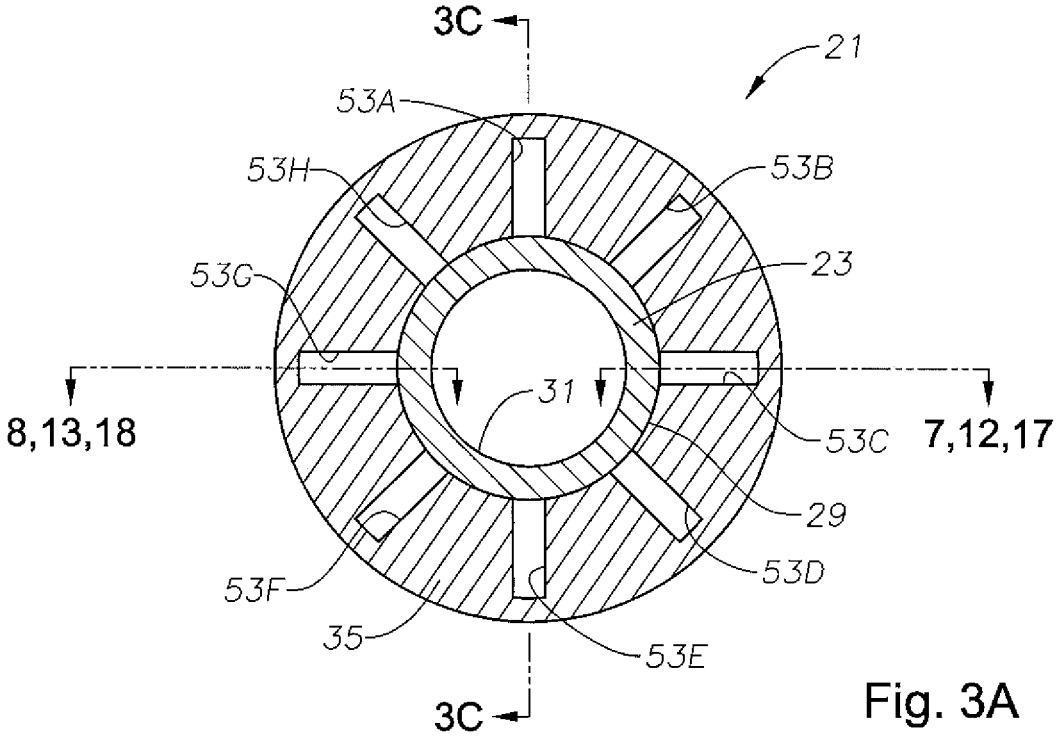
FIGS. 3A-3B are sectional views of flow restrictor devices of FIG. 2A taken along lines 3A-3A and 3B-3B, respectively, in accordance with an embodiment of the present invention.
Figure 3B:
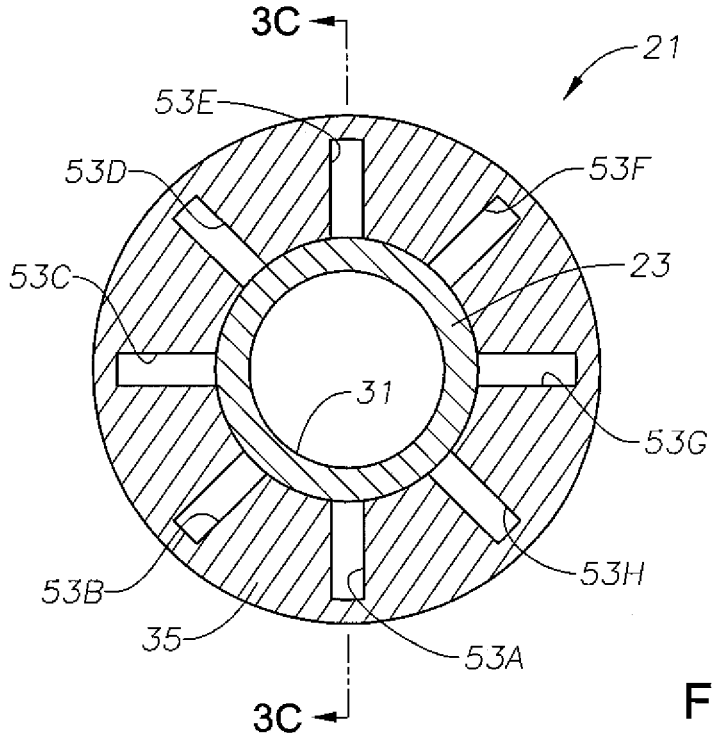
Figure 3C:
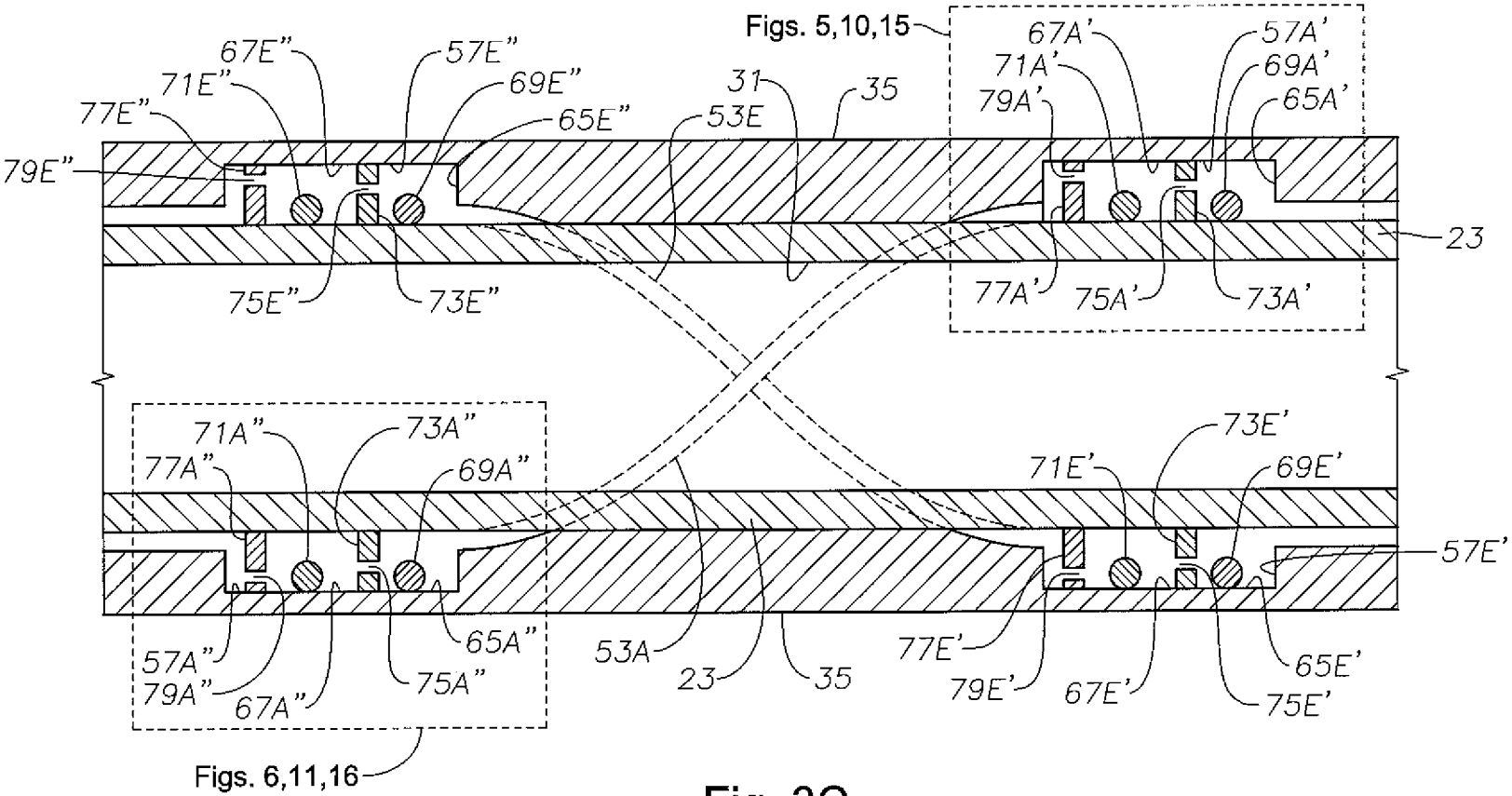
FIG. 3C is a sectional view of FIG. 3A and FIG. 3B taken along line 3C-3C of FIG. 3A and FIG. 3B.

Referring to FIG. 3A, eight passages 53A through 53H are shown. Passages 53 partially circumscribe tubular member 23 so that fluid passing through each passage flows at least partway around tubular member 23. When run-in-hole, at least one passage 53 will be positioned at a highest elevation of inflow control device 21, i.e. a twelve o'clock position as shown in FIG. 3A. Similarly, at least one passage 53 will be positioned at a lowest elevation of inflow control device 21, i.e. a six o'clock position as shown in FIG. 3A. As shown in FIG. 3B, a terminus of each passage is 180° from a head of the respective passage 53 at fluid collecting chamber 51 (FIG. 2A). As shown in FIG. 3C, a flow restrictor 57 is positioned on each end of passage 53. For example, the eight passages of the illustrated embodiment are referred to as passages 53A, 53B, 53C, 53D, 53E, 53F, 53G, and 53H, herein. Passage 53A will include a flow restrictor 57A' in passage 53A proximate to fluid collecting chamber 51. In the illustrated embodiment, flow restrictor 57A' will occupy a position that is closest to the surface or the twelve o'clock position as shown in FIG. 3A. A flow restrictor 57K will also be located in passage 53A proximate to pressure drop device 59 (FIG. 2A). Flow restrictor 57A" will occupy a position that is farthest to the surface or the six o'clock position as shown in FIG. 3B. Similarly, passage 53E will include a flow restrictor 57E' in passage 53E proximate to fluid collecting chamber 51. Flow restrictor 57E' will occupy a position that is farthest to the surface or the six o'clock position as shown in FIG. 3A. A flow restrictor 57E" will also be located in passage 53E proximate to pressure drop device 59 (FIG. 2A). Flow restrictor 57E' will occupy a position that is closest to the surface or the twelve o'clock position as shown in FIG. 3A. Inflow control device 21 will be placed in lateral 17 so that at least one passages 53A, 53B, 53C, 53D, 53E, 53F, 53G, and 53H will occupy the uppermost position, i.e. the twelve o'clock position, and at least one will occupy the lowermost position, i.e. the six o'clock position.

Referring to FIG. 3C, each flow restrictor 57 includes an upstream chamber 65 and a downstream chamber 67. An upstream ball 69 is positioned within upstream chamber 65, and a downstream ball 71 is positioned within downstream chamber 67. An upstream porting wall 73 having a port 75 separates upstream chamber 65 from downstream chamber 67, and a downstream porting wall 77 having a port 79 separates downstream chamber 67 from the next operation in passage 53. As shown in FIG. 3D, downstream porting wall 77 may be a bulkhead having an area equivalent to the cross sectional area of downstream chamber 67 so that fluid flow through downstream chamber 67 may only occur through port 79. Similarly, as shown in FIG. 3E, upstream porting wall 73 may be a bulkhead having an area equivalent to the cross sectional area of upstream chamber 65 so that fluid flow through upstream chamber 65 may only occur through port 75.

Figure 4:
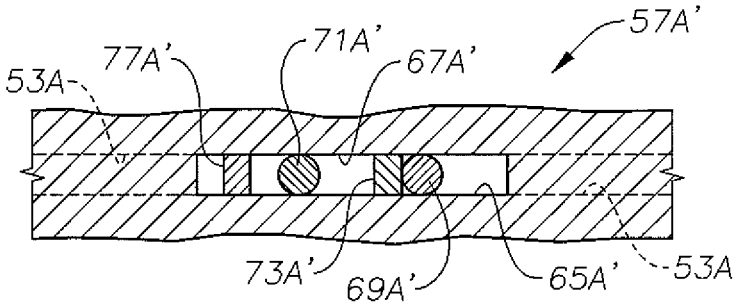
FIGS. 4-8 are schematic views of portions of the flow restrictors of FIGS. 3A-3C during production of expected reservoir fluid.

Each pair of flow restrictors 57 in each passage 53 may operate as described with respect to FIGS. 4-8. As shown in FIG. 4, each flow restrictor 57 has a width substantially equivalent to the diameter of upstream and downstream balls 69, 71 so that, balls 69, 71 may not move around the circumference of tubular member 23. As shown in FIG. 3C, balls 69, 71 may move radially toward outer diameter 29 of tubular member 23 (FIG. 1) or toward the inner diameter of tubular housing 35. In addition, balls 69, 71 may move axially in line with axis 33 (FIG. 1). By restricting circumferential movement of upstream ball 69 and down stream ball 71, effective removal of high water-to-oil ratio and gas-to-oil ratio fluid is restricted from passing into central bore 31, as described in more detail below. Upstream ball 69 has a density less than the density of oil in the formation reservoir, allowing upstream ball 69 to float in reservoir oil. Downstream ball 71 has a density that is the same as the density of oil in the formation reservoir, allowing downstream ball 71 to neither float nor sink in reservoir oil. The actual densities of upstream ball 69 and downstream ball 71 will be selected based on testing data for the particular well in which inflow control device 21 will be used.

Figure 5:
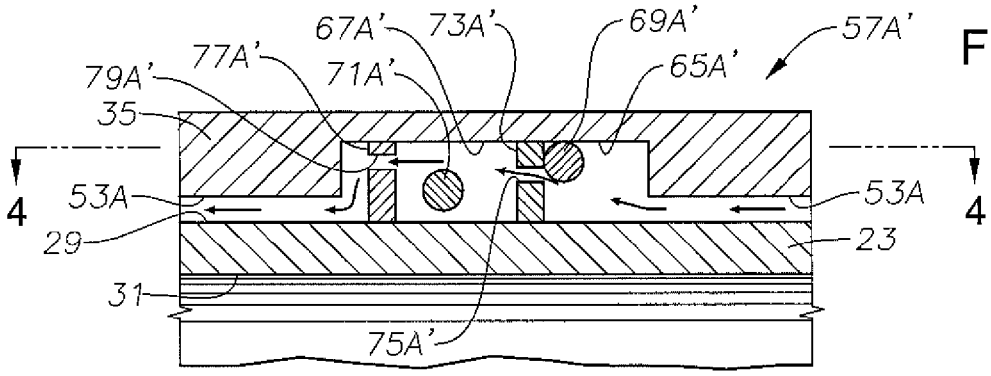
Figure 6:
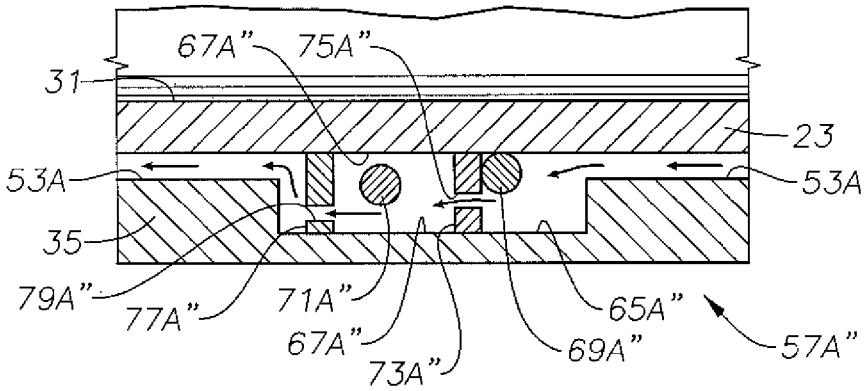

FIG. 5 and FIG. 6 illustrate flow restrictors 57A' and 57A", respectively, in a production flow that is primarily reservoir oil with a low or minimal water-to-oil and gas-to-oil ratio. Flow restrictors 57A' and 57A" will be positioned within lateral 17 (FIG. 1) so that 57A' and 57A" are the uppermost and lowermost flow restrictors 57, respectively, as illustrated in FIGS. 3A-3C. A person skilled in the art will understand that operation of flow restrictor 57E" will be similar to that of flow restrictor 57A', and operation of flow restrictor 57E' will be similar to that of flow restrictor 57A". As illustrated in FIGS. 5 and 6, and applicable to FIGS. 4-18, upstream porting wall 73 has a height that is equal to twice the diameter of upstream ball 69. Port 75 in upstream porting wall 73 will be positioned so that a portion of upstream porting wall 73 extending radially outward from a portion of flow restrictor 57 proximate to central bore 31 has a height that is equivalent to a diameter of upstream ball 69. Downstream porting wall 77 has a height that is equal to twice the diameter of downstream ball 71. Port 79 in downstream porting wall 77 will be positioned proximate to tubular housing 35 so that a center of port 79 will align with a center of downstream ball 71 when downstream ball 71 contacts tubular housing 35 and downstream porting wall 77.

When the fluid flowing through flow restrictors 57A' and 57A" has a low gas-to-oil ratio and a low water-to-oil ratio, as illustrated in FIGS. 4, 5 and 6, upstream balls 69A' and 69A", having a density less than the density of the reservoir fluid, will float, and downstream balls 71A' and 71A" will mix with the fluid. Referring to FIG. 4, upstream ball 69A will be pushed against upstream porting wall 73 by the fluid flow. Downstream ball 71A will mix within the reservoir oil and neither float nor sink. The fluid flow through downstream chamber may be turbulent or slightly non-steady. In such a fluid flow rate, the density of downstream ball 71A allows the ball to roll and move within downstream chamber 67A rather than move to block port 79A in downstream porting wall 77A. Referring to FIG. 5, upstream ball 69A' will float to a position in contact with tubular housing 35 and upstream porting wall 73A'. In this position, upstream ball 69A' will partially block port 75A' in upstream porting wall 73A', allowing a partial flow of reservoir oil. Downstream ball 71A' will mix within the reservoir oil. Reservoir oil may flow through port 79A' of downstream porting wall 77A' uninhibited by downstream ball 71A'. Referring to FIG. 6, upstream ball 69A" will float to a position in contact with tubular housing 35 and upstream porting wall 73A". In this position, upstream ball 69K will not block port 75A" in upstream porting wall 73A", allowing flow of reservoir oil uninhibited by upstream ball 69A". Downstream ball 71K will mix within the reservoir oil. Reservoir oil may flow through port 79A" of downstream porting wall 77K uninhibited by downstream ball 71K.

Figure 7:
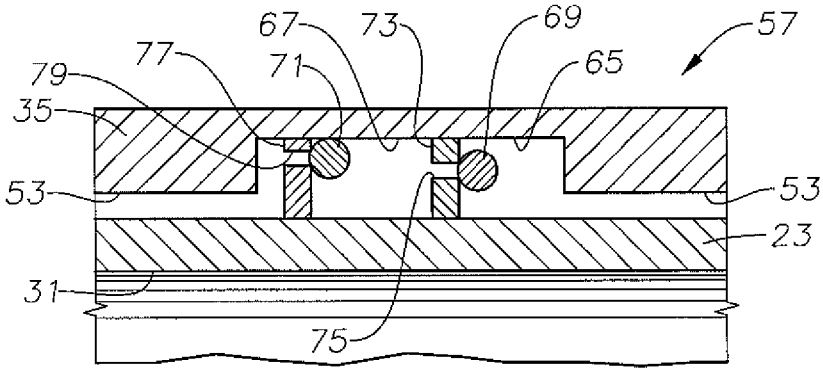
Figure 8:
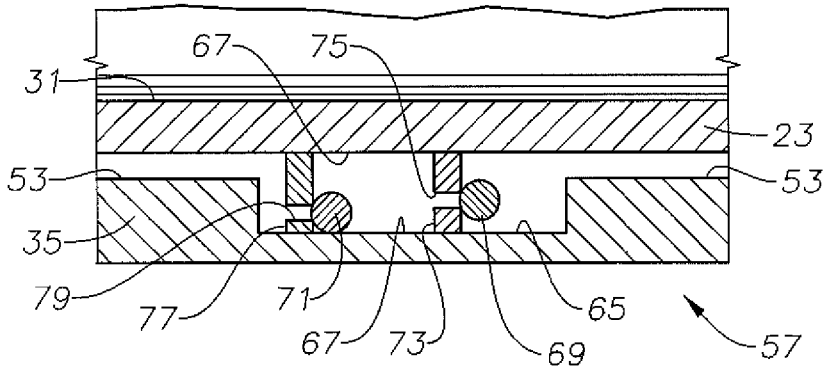

FIGS. 7 and 8 illustrate exemplary flow restrictors 57, such as flow restrictors 57B, 57C, 57D, 57F, 57G, and 57H, that do not occupy the uppermost and lowermost positions of inflow control device 21 when inflow control device 21 is installed in lateral 17. As illustrated, in reservoir oil flow having a low gas-to-oil ratio and a low water-to-oil ratio, both upstream balls 69 and downstream balls 71 will be carried by the fluid flow stream so that upstream balls 69 block port 75 in upstream porting wall 73 and downstream balls 71 block port 79 in downstream porting wall 77, preventing flow of fluid through flow restrictors 57B, 57C, 57D, 57F, 57G, and 57H in the illustrated embodiment. Thus, as shown, in a fluid flow having a low gas-to-oil ratio and a low water-to-oil ratio, only flow restrictors 57A and 57E will allow fluid flow through flow restrictors 57.

Figure 9:
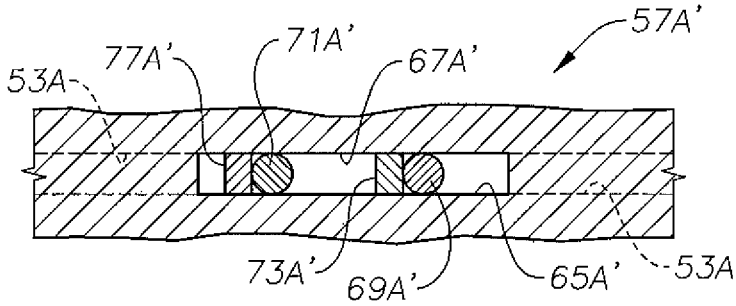
FIGS. 9-13 are schematic views of portions of the flow restrictors of FIGS. 3A-3C during production of high gas-to-oil ratio reservoir fluid.
Figure 10:
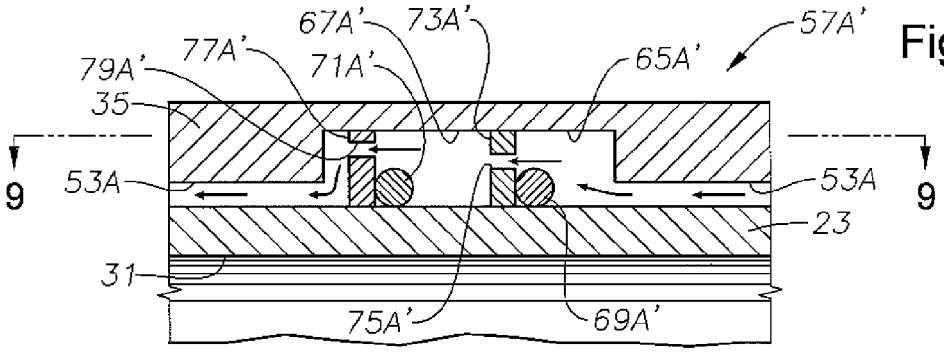

FIGS. 9-13 illustrate operation of flow restrictors 57 in a fluid flow from the reservoir having a high gas-to-oil ratio. As illustrated in FIG. 9, fluid flow having a high gas-to-oil ratio will move upstream ball 69A and downstream ball 71A against upstream porting wall 73A and downstream porting wall 77A, respectively. Referring to FIG. 10, upstream ball 69A' and downstream ball 71A', having a density that is greater than the high gas-to-oil ratio reservoir fluid, will sink. The fluid flow will carry upstream ball 69N to a position in contact with tubular member 23 and upstream porting wall 73A'. In this position, upstream ball 69A' will not inhibit flow through port 75A' of upstream porting wall 73N. Similarly, the fluid flow will carry downstream ball 71A' to a position in contact with tubular member 23 and downstream porting wall 77A'. In this position, downstream ball 71N will not inhibit flow through port 79A' of downstream porting wall 77A'.

Figure 11:
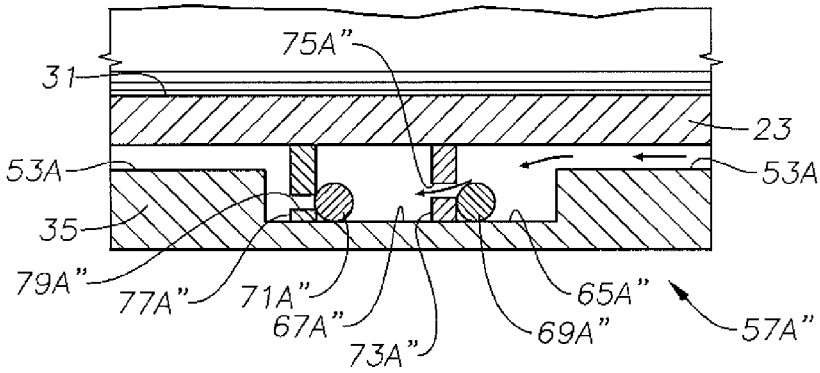

Referring to FIG. 11, upstream ball 69K and downstream ball 71K, having a density that is greater than the high gas-to-oil ratio reservoir fluid, will sink. The fluid flow will carry upstream ball 69K to a position in contact with tubular housing 35 and upstream porting wall 73K. In this position, upstream ball 69K will partially inhibit flow through port 75A" of upstream porting wall 73K. Similarly, the fluid flow will carry downstream ball 71K to a position in contact with tubular housing 35 and downstream porting wall 77K. In this position, downstream ball 71A" will prevent flow through port 79A" of downstream porting wall 77A".

Figure 12:
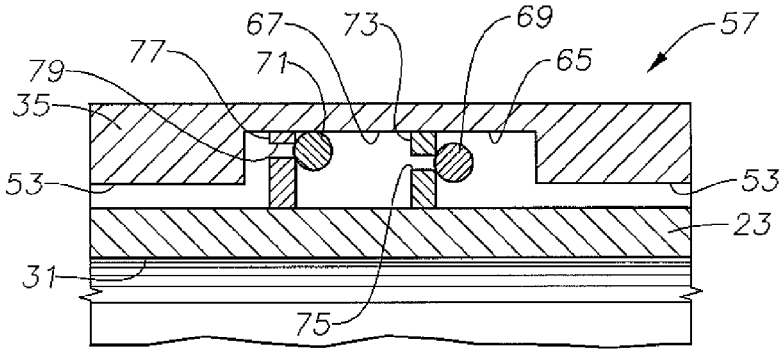
Figure 13:
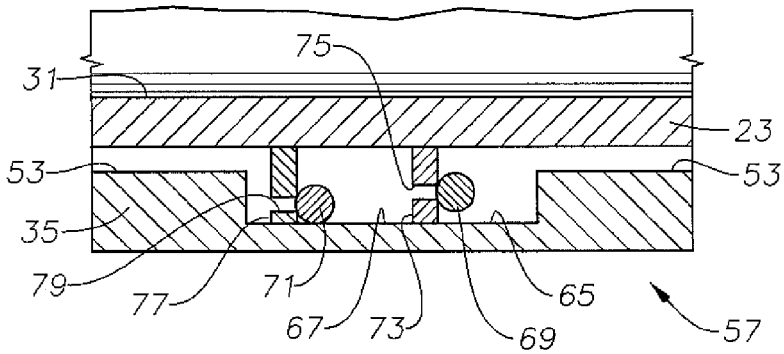

FIGS. 12 and 13 illustrate exemplary flow restrictors 57, such as flow restrictors 57B, 57C, 57D, 57F, 57G, and 57H, that do not occupy uppermost and lowermost positions of inflow control device 21 when inflow control device 21 is installed in lateral 17. As illustrated, in reservoir oil flow having a high gas-to-oil ratio, both upstream balls 69 and downstream balls 71 will be carried by the fluid flow stream so that upstream balls 69 block port 75 in upstream porting wall 73 and downstream balls 71 block port 79 in downstream porting wall 77, preventing flow of fluid through flow restrictors 57B, 57C, 57D, 57F, 57G, and 57H in the illustrated embodiment. Thus, in the illustrated embodiment, in a fluid flow having a high gas-to-oil ratio, fluid flow through flow restrictors 57 will be prevented by flow restrictors 57A" and 57E' in the lowermost flow restrictor 57 position of inflow control device 21.

Figure 14:
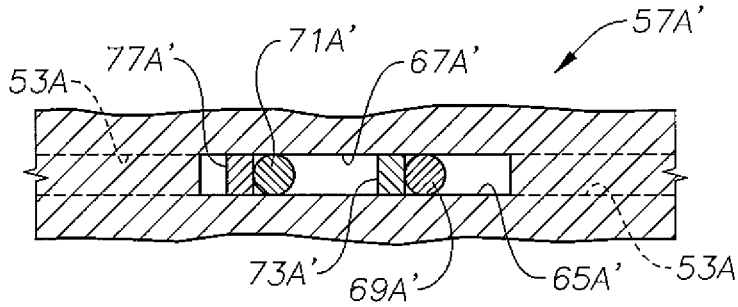
FIGS. 14-18 are schematic view of portions of the flow restrictors of FIGS. 3A-3C during production of high water-to-oil ratio reservoir fluid.
Figure 15:
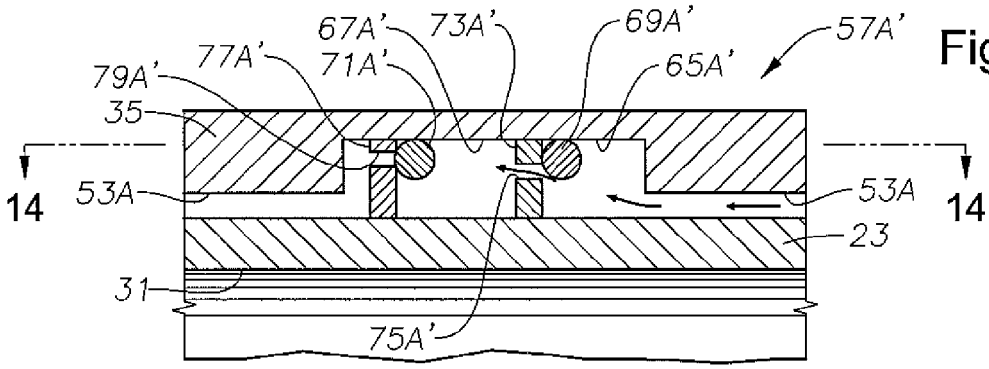

FIGS. 14-18 illustrate operation of flow restrictors 57 in a fluid flow from the reservoir having a high water-to-oil ratio. As illustrated in FIG. 14, fluid flow having a high water-to-oil ratio will move upstream ball 69A and downstream ball 71A against upstream porting wall 73A and downstream porting wall 77A, respectively. Referring to FIG. 15, upstream ball 69A' and downstream ball 71A', having a density that is less than the high water-to-oil ratio reservoir fluid will float. The fluid flow will carry upstream ball 69A' to a position in contact with tubular housing 35 and upstream porting wall 73A'. In this position, upstream ball 69N will partially inhibit flow through port 75N of upstream porting wall 73A'. Similarly, the fluid flow will carry downstream ball 71A' to a position in contact with tubular housing 35 and downstream porting wall 77A'. In this position, downstream ball 71A' will prevent flow through port 79A' of downstream porting wall 77A'.

Figure 16:
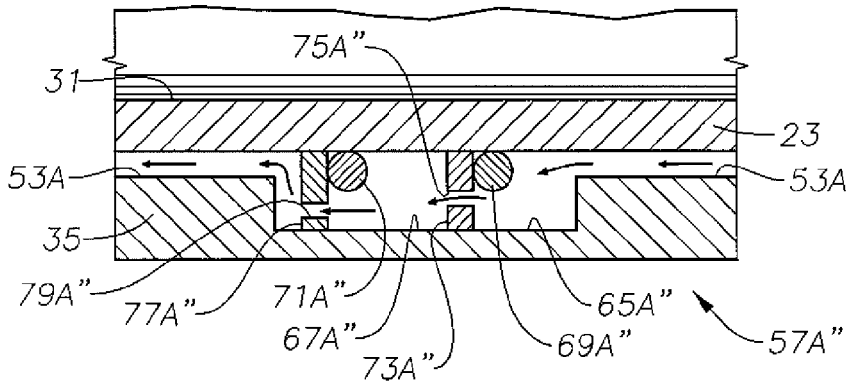

Referring to FIG. 16, upstream ball 69A" and downstream ball 71K, having a density that is less than the high water-to-oil ratio reservoir fluid will float. The fluid flow will carry upstream ball 69K to a position in contact with tubular member 23 and upstream porting wall 73K. In this position, upstream ball 69K will not inhibit flow through port 75K of upstream porting wall 73K. Similarly, the fluid flow will carry downstream ball 71K to a position in contact with tubular member 23 and downstream porting wall 77A". In this position, downstream ball 71A" will not inhibit flow through port 79A" of downstream porting wall 77A".

Figure 17:
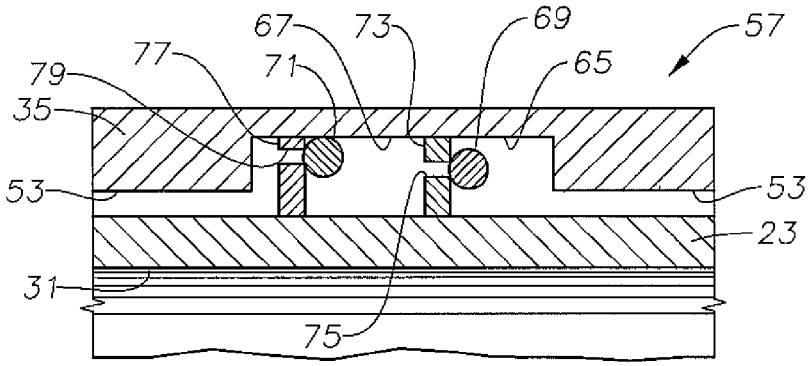
Figure 18:
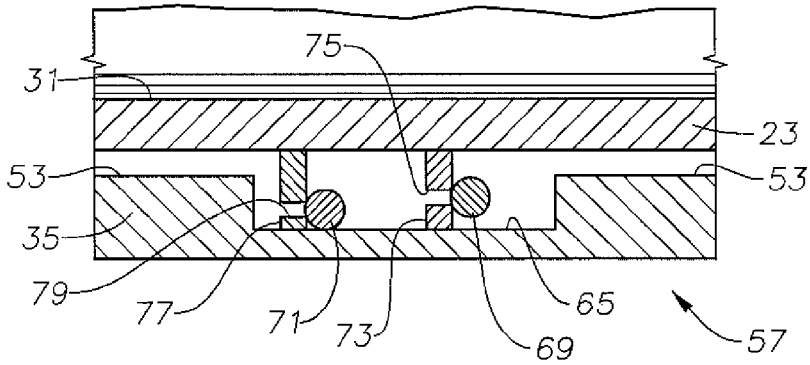

FIGS. 17 and 18 illustrate exemplary flow restrictors 57, such as flow restrictors 57B, 57C, 57D, 57F, 57G, and 57H, that do not occupy the uppermost and lowermost positions of inflow control device 21 when inflow control device 21 is installed in lateral 17. As illustrated, in reservoir oil flow having a high water-to-oil ratio, both upstream balls 69 and downstream balls 71 will be carried by the fluid flow stream so that upstream balls 69 block port 75 in upstream porting wall 73 and downstream balls 71 block port 79 in downstream porting wall 77, preventing flow of fluid through flow restrictors 57B, 57C, 57D, 57F, 57G, and 57H in the illustrated embodiment. Thus, in the illustrated embodiment, in a fluid flow having a high water-to-oil ratio, fluid flow through flow restrictors 57 will be prevented by flow restrictors 57A' and 57E" located in the uppermost flow restrictor 57 position of inflow control device 21.

Referring to FIG. 19, an end view of pressure drop device (PDD) 59 is shown. A PDD 59 will be located in each passage 53 downstream of flow restrictors 57 so that fluid flowing through each pair of flow restrictors 57 will flow into a separate PDD 59. As shown in FIG. 19, tubular housing 35 and tubular member 23 may be substantially sealed to PDD 59 so that fluid may not flow around an exterior of PDD 59. PDD 59 may include a PDD housing 81, a fluid outflow port 83, and a pressure equalization port 85.

Referring to FIGS. 20-22, pressure equalization port 85 allows fluid communication with an interior of a rod housing 87. Rod housing 87 defines a fluid chamber having a shaft chamber 89 and a piston head chamber 91. Shaft chamber 89 will have a diameter less than that of piston head chamber 91. A pressure piston 93 having a piston shaft 95 and a piston head 97 may be positioned within rod housing 87 so that piston shaft 95 is positioned within shaft chamber 89 and piston head 97 is positioned within piston head chamber 91. Pressure piston 93 may have a T shape as shown. In the illustrated embodiment pressure piston 93 is formed of a non-metallic material having a density greater than that of reservoir water. A person skilled in the art will understand that pressure piston 93 may be formed of other materials and in different configurations, provided pressure piston 93 operates as described below.

Piston shaft 95 may moveably seal to shaft chamber 89 so that fluid in piston head chamber 91 may not flow around piston shaft 95 into shaft chamber 89. Passage 53 will be in fluid communication with an end of piston head chamber 91 so that fluid flowing from flow restrictors 57 may flow into piston head chamber 91. Piston head chamber 91 will include a plurality of ports 101 allowing for fluid communication between piston head chamber 91 and an annulus 99 formed between PDD housing 81 and rod housing 87. Annulus 99 may be in fluid communication with fluid outflow port 83. Piston head 97 has an outer diameter that is substantially equivalent to the inner diameter of piston head chamber 91. Piston head 97 may move within piston head chamber 91 to inhibit fluid flow through one or more of the plurality of ports 101. Movement of pressure piston 93 is influenced in part by the length of piston shaft 95 and piston head 97. An increased length of piston shaft 95 and/or piston head 97 will increase the mass of pressure piston 93 that fluid flowing from passage 53 must move to flow to inflow production port 61, as described in more detail below. Flow through the plurality of ports 101 creates a varying pressure differential based on the number of ports 101 through which fluid can flow freely. Thus, the plurality of ports 101 reduce the flow rate into inflow fluid port 61. Fluid within piston shaft chamber 89 may be in fluid communication with inflow fluid port 61 through pressure equalization port 85. A PDD filter media 103 may be positioned within pressure equalization port 85 to prevent movement of particulate matter into piston shaft chamber 89.

Figure 23:
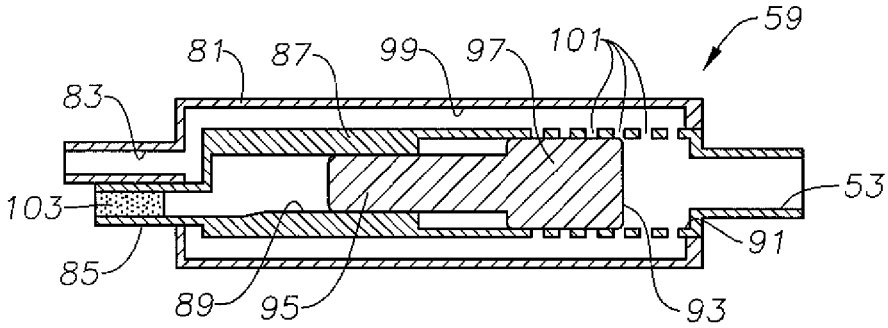
FIGS. 23-26 are sectional views of the pressure drop device of FIG. 2A illustrating operational steps of the use of the pressure drop device.
Figure 24:
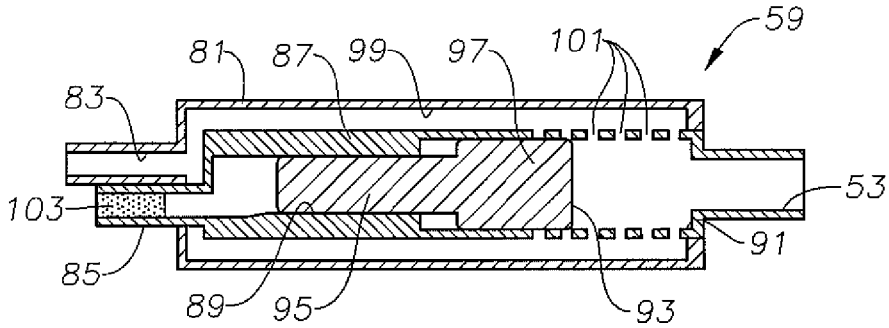

PDD 59 may operate as described below with respect to FIGS. 23-26. When inflow control device 21 (FIG. 2A) is run into position within lateral 17 (FIG. 1), pressure piston 93 will be in the position illustrated in FIG. 25. Fluid flow from passage 53 will be limited or prevented through the plurality of ports 101. Pressure piston 93 will move in response to the pressure of the reservoir oil flow. As shown in FIG. 23, in reservoir oil flow having a low gas-to-oil ratio, a low water-to-oil ratio, and a low pressure reservoir oil flow, pressure piston 93 will move partially past the plurality of ports 101 so that only a portion of the plurality of ports 101 allow free flow of fluid from passage 53 into annulus 99. Thus, production flow is reduced when the fluid pressure in the reservoir is reduced, aiding in the prevention of coning associated with over production from a particular zone of the reservoir. As shown in FIG. 24, in reservoir oil flow having a low gas-to-oil ratio, a low water-to-oil ratio, and a high pressure reservoir oil flow, pressure piston 93 will move past the plurality of ports 101 so that most of the plurality of ports 101 allow free flow of fluid from passage 53 into annulus 99. Thus, production flow is reduced less when the fluid pressure in the reservoir is increased, allowing increased fluid flow when warranted by sufficient reservoir pressure.

Figure 25:
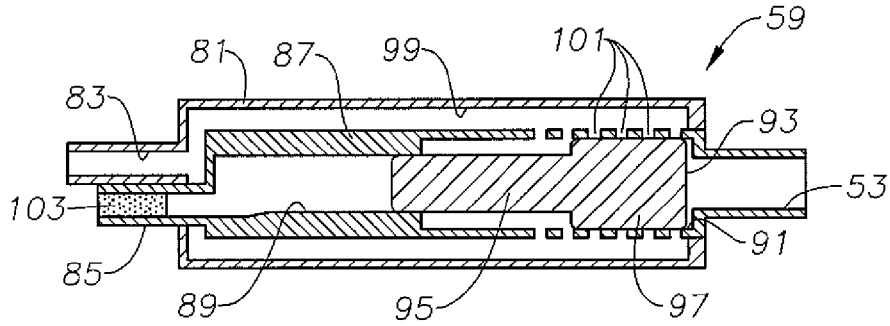
Figure 26:
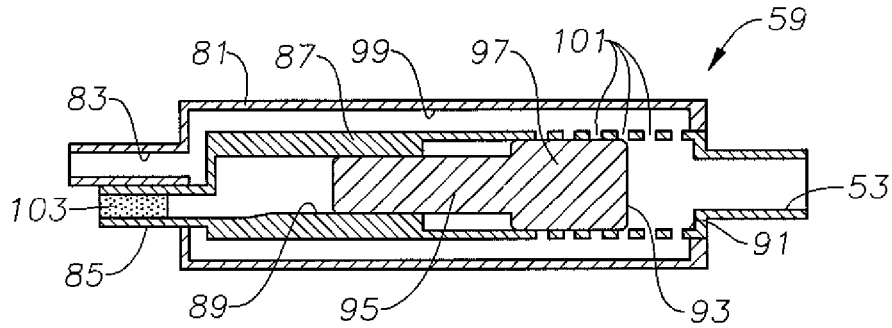

As shown in FIG. 25, in reservoir oil flow having a low gas-to-oil ratio, a high water-to-oil ratio, and a low pressure reservoir oil flow, pressure piston 93 will move negligibly so that fluid may only flow through the plurality of ports 101 in a gap between piston head 97 and piston head chamber 91 (FIG. 22). Thus, production flow is severely limited when the fluid pressure in the reservoir is reduced and the zone around inflow control device 21 produces a substantial amount of water, further limiting the amount of water produced to the surface. As shown in FIG. 26, in reservoir oil flow having a low gas-to-oil ratio, a high water-to-oil ratio, and a high pressure reservoir oil flow, pressure piston 93 will move partially past the plurality of ports 101 so that only a portion of the plurality of ports 101 allow free flow of fluid from passage 53 into annulus 99. Thus, production flow is reduced when the fluid pressure in the reservoir is increased, but producing a greater than expected amount of water, aiding in the reduction of water production from the reservoir. In the disclosed embodiments, pressure piston 93 has a density greater than the density of the high water-to-oil ratio reservoir fluid. Thus, it will take significantly more pressure to move pressure piston 93 when the reservoir fluid has a high water-to-oil ratio. As pressure piston 93 moves within rod housing 87, fluid in shaft chamber 89 may flow through pressure equalization port 85 to prevent over pressurization of shaft chamber 89 that would prevent movement of pressure piston 93 away from passage 53. Similarly, fluid in shaft chamber 89 may flow through pressure equalization port 85 to prevent creation of a vacuum within shaft chamber 89 as pressure piston 93 moves toward passage 53. Pressure piston 93 may be reset to the position illustrated in FIG. 25 at any time during operation of inflow control device 21 in a manner described in more detail below.

Figure 27:
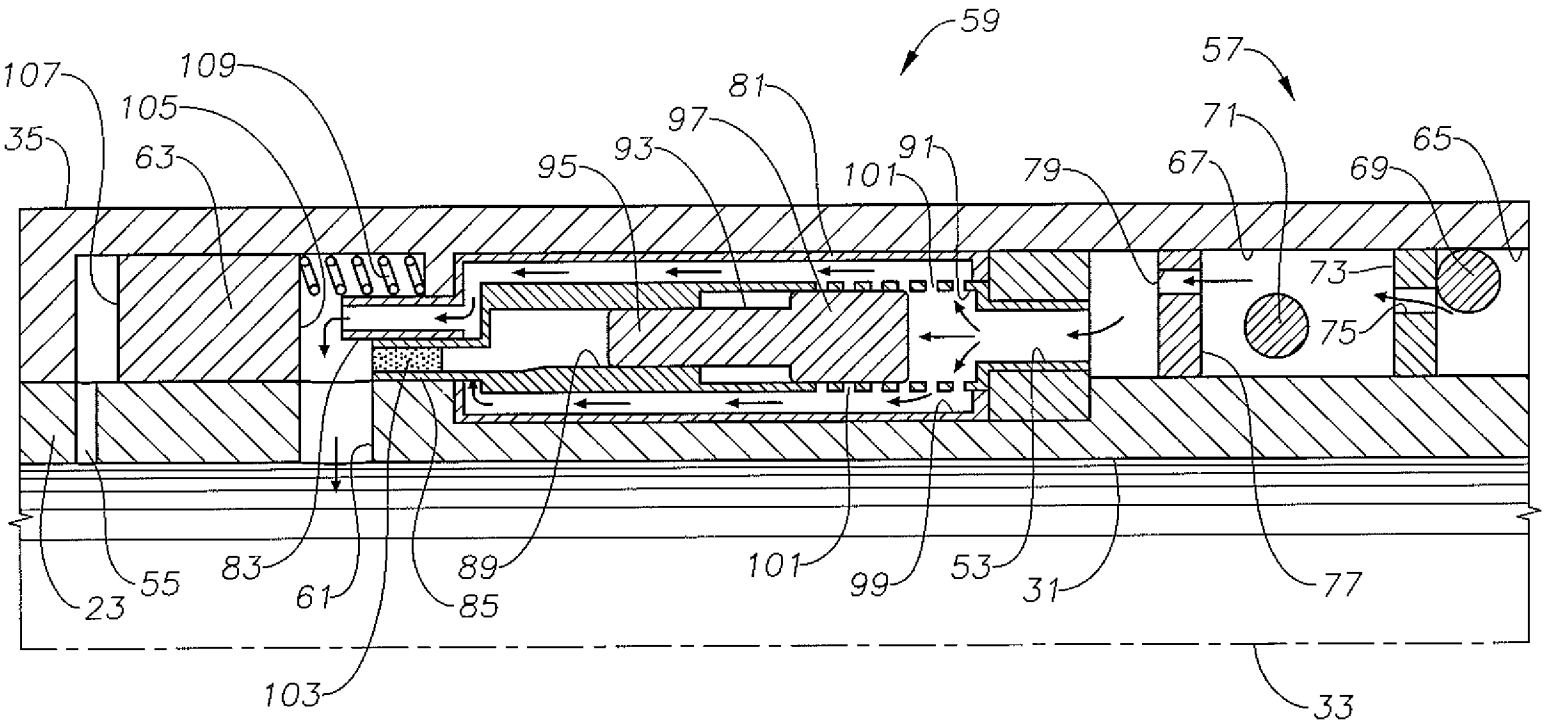
FIGS. 27 and 28 are detail sectional views of the pressure drop device of FIG. 2A illustrating operational steps of a flow restriction process.

Referring now to FIG. 27, fluid flow through fluid outflow port 83 may be may be restricted by piston 63, which is downstream of PDD 59. Piston 63 may have a first end 105 proximate to inflow fluid port 61, and a second end 107 proximate to piston fluid port 55. Fluid outflow port 83 terminates in inflow fluid port 61 opposite first end 105 of piston 63. Piston 63 is moveable so that first end 105 may contact fluid outflow port 83 to prevent flow of fluid from PDD 59, as described below. A piston biasing spring 109 is positioned between first end 105 of piston 63 and an oppositely facing wall of tubular housing 35 proximate to fluid outflow port 83. In the illustrated embodiment, piston biasing spring 109 biases piston 63 to the position shown in FIG. 27 so that fluid may flow from PDD 59 through fluid outflow port 83 into inflow fluid port 61 and then into central bore 31 for production to the surface. Piston 63 may be a cylindrical member positioned within a corresponding cylindrical chamber so that piston 63 may prevent flow through a respective flow passage 53 when first end 105 of piston 63 is in contact with a corresponding fluid outflow port 83. In these embodiments, a separate piston 63 will correspond with each flow passage 53. In alternative embodiments, piston 63 may be an annular member positioned within a corresponding annular chamber so that piston 63 may prevent flow through all flow passages 53 simultaneously.

Figure 28:
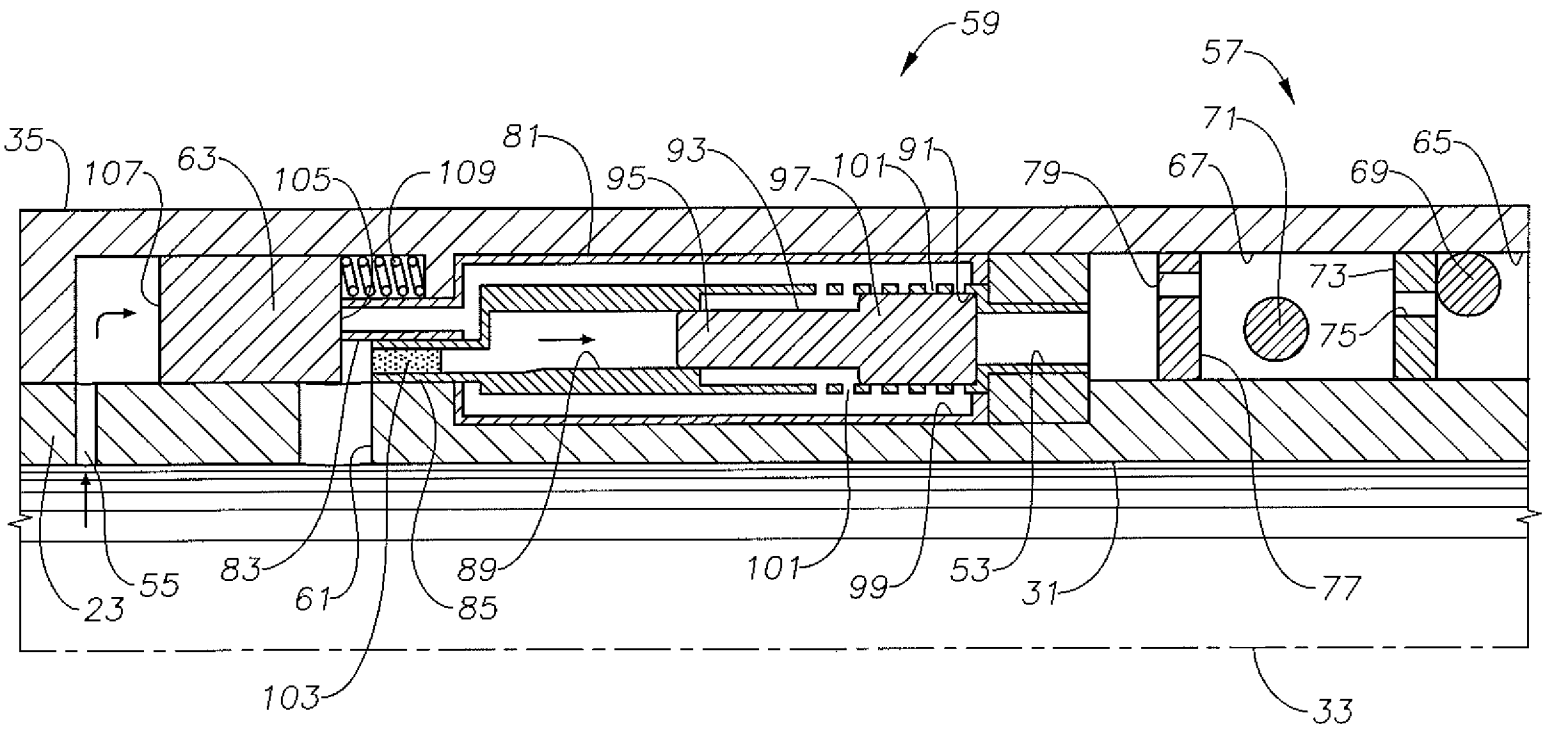

Referring to FIG. 28, fluid may be pressurized from the surface so that fluid will flow into piston fluid port 55. The fluid will act on second surface 107 of piston 63 moving piston 63 against fluid outflow port 83, blocking flow of fluid into inflow fluid port 61 from PDD 59. Piston biasing spring 109 will compress. When fluid pressure is removed from central bore 31, piston biasing spring 109, along with reservoir fluid pressure flowing through fluid outflow port 83 of PDD 59 will move piston 63 out of inflow fluid port 61, allowing for production of reservoir fluid to the surface.

Figure 29:
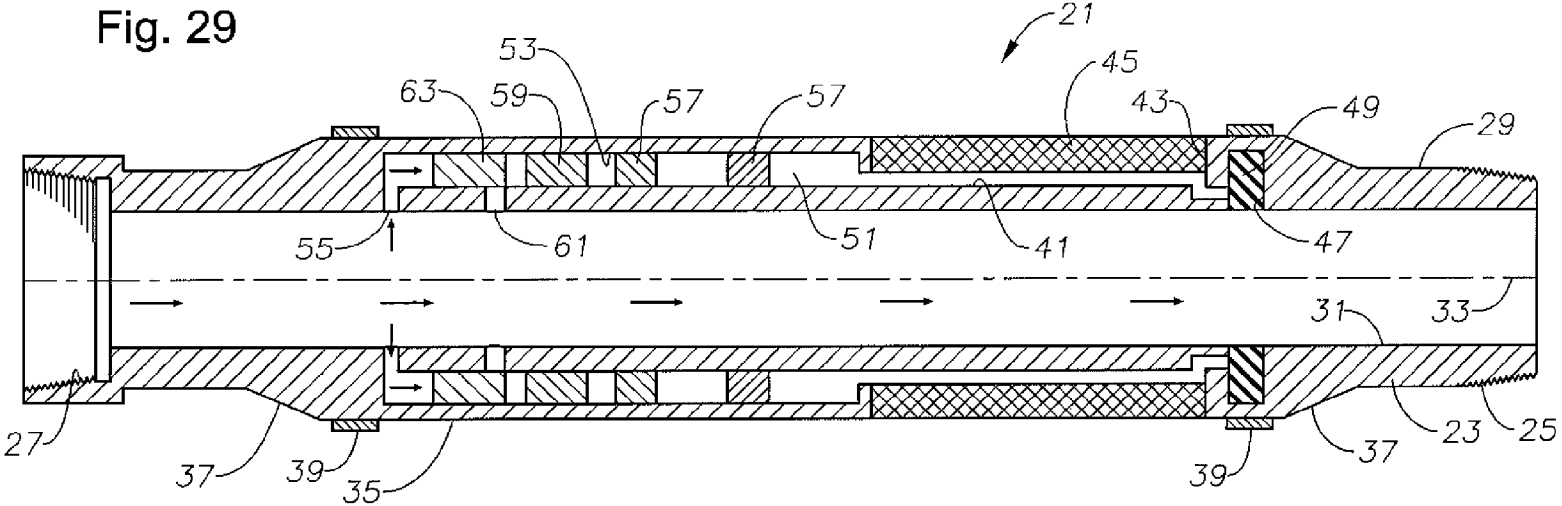
FIG. 29 is a sectional view of the inflow control device of FIG. 1 in a nm-in-hole process.

FIG. 29 illustrates a run-in-hole, ream, or circulation process that may be performed with inflow control device 21. The processes as described with respect to FIG. 29 are those which may be conducted while installing inflow control device 21 in place within lateral 17 (FIG. 1). During the run-in-hole process of FIG. 29, fluid will be circulated down central bore 31 from the surface through production tubing 19. The fluid will be circulated at a pressure sufficient to move piston 63 to the position of FIG. 28, preventing flow of circulation fluid from central bore 31 through PDD 59, flow restrictors 57 and filter media 45. Fluid pressure circulated through central bore 31 in the operative embodiment of FIG. 29 will have a pressure less than that needed to actuate pressure disc 49. Thus, pressure disc 49 will prevent flow of fluid from central bore 31 into fluid wash port 47.

During a production process, as shown in FIG. 2A, fluid pressure will not be applied to central bore 31. Reservoir fluid will be allowed to flow through filter media 45 and into fluid collection chamber 51. From fluid collection chamber 51, fluid will flow into fluid passages 53 (FIGS. 3A-3C). In the illustrated embodiment, passage 53A will be positioned to be at the point closest to the surface within lateral 17 (FIG. 1). Reservoir fluid will flow through passages 53 and into respective flow restrictors 57. Flow restrictors 57 will operate as described above with respect to FIGS. 4-18 to prevent or limit the flow of high gas-to-oil ratio and high water-to-oil ratio reservoir fluid from passing through flow restrictors 57. Reservoir fluid that is allowed to flow through flow restrictors 57 will then flow into PDDs 59. There, each PDD 59 will create a varying pressure differential as described above with respect to FIGS. 19-26 to aid in the creation of a balanced production profile across the entirety of lateral 17 (FIG. 1). At anytime after production of fluid from the reservoir commences, pressure piston 93 (FIG. 29) may be reset to the run-in-hole position of FIG. 29 by applying fluid pressure to production string 19 in the manner described above with respect to FIG. 29. The applied fluid pressure will actuate piston 63 to close outflow port 83. However, piston 63 will not prevent flow of fluid pressure through pressure equalization port 85. Thus, fluid pressure may be applied to piston shaft 95, causing pressure piston 93 to move to the position illustrated in FIG. 25.

Figure 30:
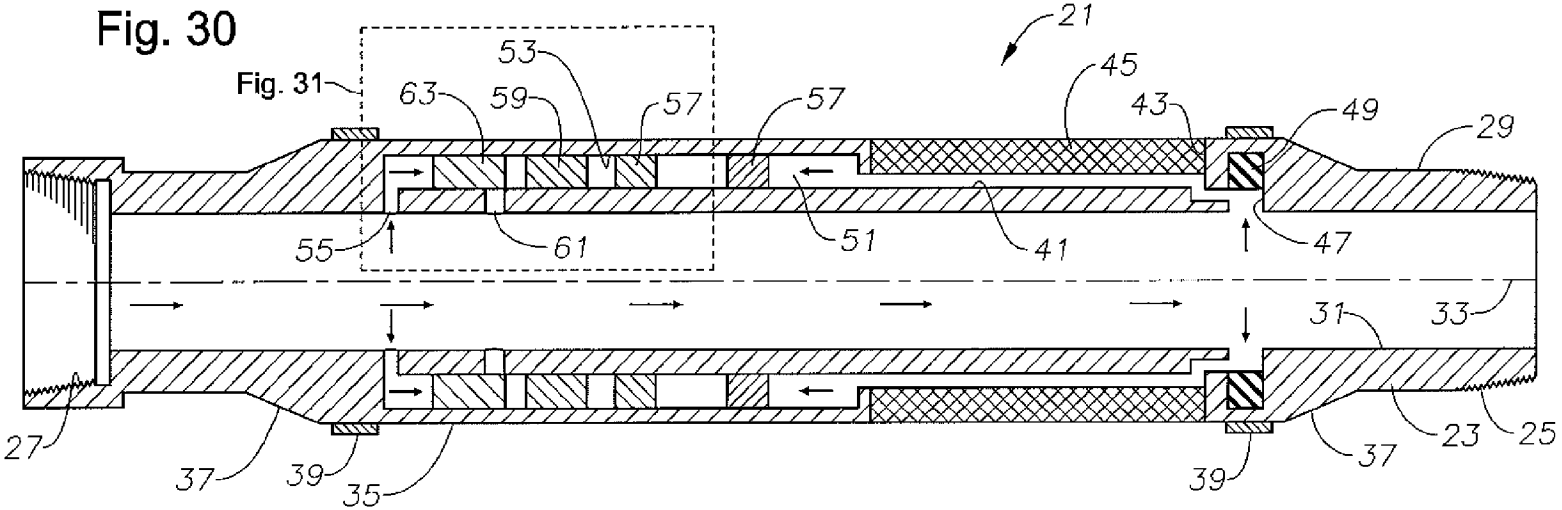
FIG. 30 is a sectional view of the inflow control device of FIG. 1 in a remedial process.

During the production process of FIG. 2A, production logging operations may be conducted to establish baseline performance of the well intervals in which inflow control device 21 is placed. When well production deviates significantly and unexpectedly, additional production logging operations may be conducted to determine which well interval is performing poorly. Once the interval is identified, a remedial process may be performed. Alternatively, the entire production string 19 and all inflow control devices 21 installed thereon may be washed in the same operation. Referring to FIG. 30, a remedial or cleanout process is shown. During the remedial process, a wash fluid, such as an acid wash like acidic brine, will be supplied to central bore 31 and raised to a fluid pressure greater than the fluid pressure applied during the run-in-hole process. For example, the fluid pressure needed to actuate pressure disc 49 may be approximately 1,500 p.s.i. above the fluid pressure within central bore 31 during the production process of FIG. 2A. Further, the fluid pressure needed to actuate pressure disc 49 may be approximately 1,000 p.s.i. above the fluid pressure within central bore 31 during the run-in-hole or circulation process of FIG. 29.

Figure 31:
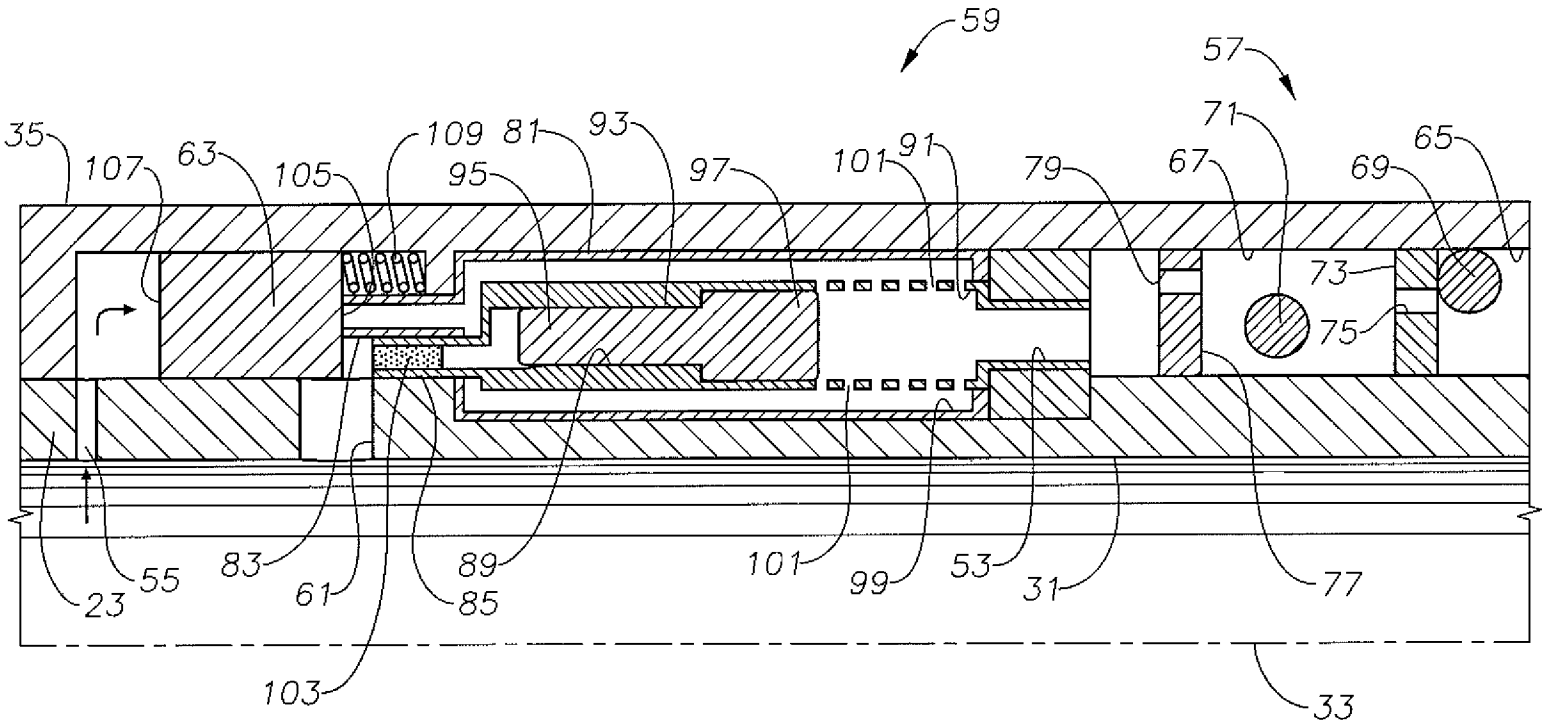
FIG. 31 is sectional view of the pressure drop device of FIG. 30 illustrating an operational step of the pressure drop device during the remedial process.

The wash fluid will move piston 63 as described above with respect to FIG. 31 to prevent flow of the wash fluid into PDD 59 and flow restrictors 57 through inflow fluid port 61. The fluid pressure of the wash fluid will cause pressure disc 49 to compress, radially outward so that wash fluid may flow into fluid wash port 47. The wash fluid may then flow through fluid wash port 47 and through filter media 45 into the reservoir. Thus, any particulate matter that may have lodged in filter media 45 may be removed by the reversal of fluid through filter media 45. In an embodiment, the wash fluid comprises an acidic wash fluid so that particulates made of carbonate material, for instance where the wellbore penetrates a carbonate reservoir, may be dissolved by the wash fluid. Wash fluid pressure supplied through pressure disc 49 and wash port 47 may also be supplied to fluid collecting chamber 51 and passages 53. In this manner, PDD 59 may also receive wash fluid pressure through flow restrictor 57. Thus, pressure piston 93 of PDD 59 may receive wash fluid pressure at piston head 97 through flow restrictor 57 and wash fluid pressure at piston shaft 95 through pressure equalization port 85 at inflow fluid port 61. Piston head 97 may have a larger surface area subjected to wash fluid pressure than piston shaft 95; thus, pressure piston 93 may move to the position of FIG. 31 during remedial operations of FIG. 30. By opening PDD 59 in this manner, when wash fluid pressure is removed from production tubing 19, wash fluid pushed into the reservoir may flow back into central bore 31 through inflow control device 21. This will allow wash fluid to be circulated out of production tubing 19. A fluid pressure less than the activation pressure of pressure disc 49 may then be supplied from the surface to return PDD 59 to the position of FIG. 25 for production operations as described above. In an embodiment, a separate operating media, such as coiled tubing, may supply fluid pressure to set PDD 59 to the position of FIG. 25 for production operations as described above.

While illustrated and described with respect to a horizontal well completion, a person skilled in the art will understand that the disclosed inflow control device 21 may be used in a vertical well completion, such as that depicted in FIG. 1. Inflow control device 21 may generally operate as described above with respect to FIGS. 2-30, while requiring additional reservoir pressure to compensate for the additional restrictive effects of gravity.

Accordingly, the disclosed embodiments provide numerous advantages over prior art embodiments. For example, the disclosed embodiments provide an inflow control device that may be used to create a pressure drop to reduce reservoir fluid flow and maintain a balanced production profile across multiple production zones, particularly those at the same elevation. The disclosed inflow control devices accommodate varying reservoir pressure by varying the pressure differential in response to the reservoir pressure. Still further, the disclosed embodiments will restrict the flow of production fluid having high volumes of water or gas based on the ratio of those substances within the reservoir fluid. In addition, the disclosed embodiments will remove solid particulate matter from the reservoir fluid flow. The disclosed embodiments remove particulates and include a process to allow for washing of the inflow control device while in place in hole. This allows for better handling of viscous or heavy oil and a longer life of the inflow control device with fewer problems related to plugging or blockage as compared to other inflow control devices. Still further, the disclosed embodiments allow an operator to open and close the device from the surface without the need for additional hydraulic or electric equipment and umbilicals.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An inflow control device for controlling fluid flow from a subsurface fluid reservoir into a production tubing string, the inflow control device comprising:

a tubular member defining a central bore having an axis, wherein upstream and downstream ends of the tubular member couple to the production tubing string;

a plurality of passages formed in a wall of the tubular member;

an upstream inlet to the plurality of passages leading to an exterior of the tubular member to accept fluid;

each passage having at least two flow restrictors with floatation elements of selected and different densities to restrict flow through the flow restrictors in response to a density of the fluid;

at least one pressure drop device positioned within each passage in fluid communication with an outflow of the flow restrictors, the pressure drop device having a pressure piston for creating a pressure differential in the flowing fluid based on the reservoir fluid pressure; and wherein an outflow of the pressure drop device flows into an inflow fluid port in communication with the central bore.

2. The inflow control device of claim 1, further comprising a filter media positioned within an annular opening defined by the tubular member near an upstream end of the inflow control device, the filter media allowing fluid communication between the subsurface fluid reservoir and the upstream inlet and limiting flow of particulate matter into the inflow control device.

3. The inflow control device of claim 2, wherein a pressure actuated member is positioned within the wall of the tubular member and actuable in response to a pressure within the central bore to allow fluid communication from the central bore to the filter media to remove particulates from the filter media.

4. The inflow control device of claim 1, wherein:

each passage of the plurality of passages partially circumscribes the tubular member so that a terminus of each passage is 180 degrees from a head of the passage; and the at least two flow restrictors are positioned within each passage to restrict flow of reservoir fluid having a high water-to-oil ratio and a high gas-to-oil ratio.

5. The inflow control device of claim 4, wherein:

at least one passage in the plurality of passages has a vertically oriented head and a vertically oriented terminus;

at least one of the at least two flow restrictors is at a highest elevation of the inflow control device; and at least one of the at least two flow restrictors is at a lowest elevation of the inflow control device.

6. The inflow control device of claim 1, wherein the flow restrictors allow radial and axial movement of the floatation members and restrict circumferential movement of the floatation members.

7. The inflow control device of claim 1, wherein pressure piston comprises a first piston and wherein a second piston is positioned proximate to the plurality of passages to choke flow of fluid through the inflow fluid port in response to fluid pressure applied to the production string from a surface.

8. The inflow control device of claim 1, further comprising:

a tubular housing circumscribing the tubular member;

wherein an inner diameter of the tubular housing defines an annulus between the tubular housing and the tubular member; and wherein the plurality of passages, the at least two flow restrictors, and the pressure drop device are formed within the annulus.

9. The inflow control device of claim 1, wherein the pressure drop device comprises:

a pressure drop device housing having a plurality of ports along an axis of the pressure drop device housing, an opening in an upstream end, and a pressure equalization port in a downstream end;

wherein the pressure drop device housing defines a pressure drop device annulus between the pressure drop device housing and the tubular member, the pressure drop device annulus in fluid communication with the inflow fluid port;

the pressure piston positioned within the pressure drop device housing; and wherein the pressure piston moves in response to the fluid pressure at the opening and fluid pressure in the pressure equalization port to expose portions of the plurality of ports and restrict flow of reservoir fluid passing into the inflow fluid port.

10. The inflow control device of claim 9, wherein:

in the event the reservoir fluid flowing through the opening has an expected gas-to-oil ratio and water-to-oil ratio and a low pressure, the pressure piston will move partially to expose a portion of the plurality of ports in the pressure drop device housing to allow reservoir fluid to flow into the pressure drop device annulus and into the inflow fluid port;

in the event the reservoir fluid flowing through the opening has an expected gas to oil ratio and water-to-oil ratio and a high pressure, the pressure piston will move to expose a majority of the plurality of ports in the pressure drop device housing to allow reservoir fluid to flow into the pressure drop device annulus and through the inflow fluid port;

in the event the reservoir fluid flowing through the opening has a higher than expected water-to-oil ratio and a low pressure, the pressure piston will move negligibly, substantially blocking the plurality of ports to flow of fluid through the opening in the pressure drop device housing; and in the event the reservoir fluid flowing through the opening has a higher than expected water-to-oil ratio and a high pressure, the pressure piston will move partially to expose a portion of the plurality of ports in the pressure drop device housing to allow reservoir fluid to flow into the pressure drop device annulus and through the inflow fluid port.

11. An inflow control device for controlling fluid flow from a subsurface fluid reservoir into a production tubing string for production to a surface, the inflow control device comprising:

a tubular member defining a central bore having an axis;

a plurality of passages formed in a wall of the tubular member;

wherein each passage partially circumscribes the tubular member so that a terminus of each passage is 180 degrees from a head of the passage;

at least two flow restrictors having floatation members of selected and different densities positioned within each flow restrictor to restrict flow of reservoir fluid having a high water-to-oil ratio and a high gas-to-oil ratio;

wherein a passage of the plurality of passages is vertically oriented so that at least one of the corresponding flow restrictors is at a highest elevation of the inflow control device and at least one of the corresponding flow restrictors is at a lowest elevation of the inflow control device;

at least one pressure drop device positioned within each passage in fluid communication with an outflow of the flow restrictors, the pressure drop device for creating a pressure differential in the flowing fluid with a pressure piston in response to the reservoir fluid pressure;

wherein an outflow of the pressure drop device flows into an inflow fluid port in communication with the central bore;

a pressure actuated piston positioned downstream of the pressure drop device to restrict flow of fluid from the plurality of passages into the central bore in response to fluid pressure applied to the production tubing string at the surface;

a filter media positioned within an annular opening defined by the tubular member near an upstream end of the inflow control device, the filter media allowing fluid communication between the subsurface fluid reservoir and the plurality of passages; and a pressure actuated member positioned on an upstream end of the inflow control device and actuable in response to a pressure within the central bore to allow fluid communication from the central bore to the filter media to clean the filter media.

12. The inflow control device of claim 11, wherein:

the at least two flow restrictors in each passage of the plurality of passages comprise an upstream flow restrictor and a downstream flow restrictor in series with each other;

the upstream flow restrictor is proximate to the fluid collection chamber at the head of the passage, and the downstream flow restrictor is proximate to the terminus of the passage; and in the event the fluid reservoir has at least one of a high gas-to-oil ratio and a high water to oil ratio, at least one of the upstream flow restrictor and the downstream flow restrictor will limit flow of reservoir fluid in response to the density of the reservoir fluid.

13. The inflow control device of claim 11, wherein each flow restrictor comprises:

an upstream chamber and a downstream chamber;

an upstream porting wall separating the upstream chamber from the downstream chamber, the upstream porting wall defining an upstream port;

a downstream porting wall separating the downstream chamber from the passage, the downstream porting wall defining a downstream port;

an upstream member of a lighter density positioned within the upstream chamber;

a downstream member of a heavier density positioned within the downstream chamber;

wherein the upstream and downstream chambers allow radial and axial movement of the upstream and downstream members and restrict circumferential movement of the upstream and downstream members; and wherein the upstream and downstream members move in response to a density of the fluid passing through the flow restrictors to mate with the upstream porting wall port and the downstream porting wall port, respectively, to restrict flow of fluid having a high gas-to-oil ratio and a high water-to-oil ratio.

14. The inflow control device of claim 13, wherein:

the upstream port is positioned proximate to an outer diameter of the tubular member so that an outer edge of the upstream port will coincide with a center of the upstream member when the upstream member contacts the upstream porting wall and the tubular member; and the downstream port is positioned proximate to the outer diameter of the tubular member so that a center of the downstream port will coincide with a center of the downstream member when the downstream member contacts the downstream porting wall and the tubular member.

15. The inflow control device of claim 13, wherein:

in the event that the reservoir fluid has an expected gas-to-oil ratio and water-to-oil ratio, the upstream member will float in the reservoir fluid and the downstream member will neither float nor sink in the reservoir fluid;

in the event that the reservoir fluid has higher than expected gas-to-oil ratio, the upstream member and the downstream member will sink in the reservoir fluid; and in the event that the reservoir fluid has a higher than expected water-to-oil ratio, the upstream member and the downstream member will sink in the reservoir fluid.

16. The inflow control device of claim 11, wherein the pressure drop device comprises:

a pressure drop device housing having a plurality of ports along an axis of the pressure drop device housing, an opening in an upstream end, and a pressure equalization port in a downstream end;

wherein the pressure drop device housing defines a pressure drop device annulus between the pressure drop device housing and the tubular member, the pressure drop device annulus in fluid communication with the inflow fluid port;

the pressure piston positioned within the pressure drop device housing; and wherein the pressure piston moves in response to the fluid pressure at the opening and fluid pressure in the pressure equalization port to expose portions of the plurality of ports and restrict flow of reservoir fluid passing into the inflow fluid port.

17. The inflow control device of claim 16, wherein:

in the event the reservoir fluid flowing through the opening has an expected gas-to-oil ratio and water-to-oil ratio and a low pressure, the pressure piston will move partially to expose a portion of the plurality of ports in the pressure drop device housing to allow reservoir fluid to flow into the pressure drop device annulus and into the inflow fluid port;

in the event the reservoir fluid flowing through the opening has an expected gas to oil ratio and water-to-oil ratio and a high pressure, the pressure piston will move to expose a majority of the plurality of ports in the pressure drop device housing to allow reservoir fluid to flow into the pressure drop device annulus and through the inflow fluid port;

in the event the reservoir fluid flowing through the opening has a higher than expected water-to-oil ratio and a low pressure, the pressure piston will move negligibly, substantially blocking the plurality of ports to flow of fluid through the opening in the pressure drop device housing; and in the event the reservoir fluid flowing through the opening has a higher than expected water-to-oil ratio and a high pressure, the pressure piston will move partially to expose a portion of the plurality of ports in the pressure drop device housing to allow reservoir fluid to flow into the pressure drop device annulus and through the inflow fluid port.

18. The inflow control device of claim 11, wherein the pressure actuated piston comprises:

a piston having a downstream end in fluid communication with a piston fluid port and an upstream end in fluid communication with the inflow fluid port; and wherein the pressure actuated piston is movable between an unchoked and a choked position in response to fluid pressure applied to the production string to allow and prevent fluid flow from the at least one pressure drop device into the inflow fluid port.

* * * * *